US008858354B2

(12) United States Patent
Pak et al.

(10) Patent No.: US 8,858,354 B2
(45) Date of Patent: Oct. 14, 2014

(54) GOLF PUTTER WITH MARKER- AND BALL-HANDLING FEATURES

(75) Inventors: Hyong Kun Pak, Twin Falls, ID (US); Jerry Wayde Johnson, Hazelton, ID (US)

(73) Assignee: Hyong Kun Pak, Twin Falls, ID (US)

( * ) Notice: Subject to any disclaimer, the term of this patent is extended or adjusted under 35 U.S.C. 154(b) by 243 days.

(21) Appl. No.: 13/417,966

(22) Filed: Mar. 12, 2012

(65) Prior Publication Data

US 2013/0237338 A1 Sep. 12, 2013

(51) Int. Cl.
*A63B 47/02* (2006.01)
*A63B 53/00* (2006.01)

(52) U.S. Cl.
USPC ..... 473/286; 473/285; 473/240

(58) Field of Classification Search
USPC ..... 473/285–286, 406, 240–241; 294/19.2
See application file for complete search history.

(56) References Cited

U.S. PATENT DOCUMENTS

| | | | | |
|---|---|---|---|---|
| 1,380,526 | A | 6/1921 | Carpenter | |
| 2,609,198 | A | 9/1952 | Armstrong | |
| 4,013,295 | A * | 3/1977 | Baughman | 473/286 |
| 4,017,082 | A | 4/1977 | Channing et al. | |
| 4,248,430 | A | 2/1981 | Kepler | |
| 5,165,744 | A * | 11/1992 | Vogrin | 294/19.2 |
| 5,310,177 | A * | 5/1994 | Conrad et al. | 473/133 |
| 5,417,426 | A | 5/1995 | Bayer | |
| 5,485,999 | A | 1/1996 | Hull et al. | |
| 5,645,498 | A * | 7/1997 | Cretella | 473/386 |
| 5,759,117 | A * | 6/1998 | Erickson, Jr. | 473/386 |
| 6,899,635 | B2 | 5/2005 | Nadratowski et al. | |
| 7,059,971 | B1 | 6/2006 | Schmitt | |
| 7,086,971 | B2 * | 8/2006 | Zmetra | 473/386 |
| 7,559,848 | B2 * | 7/2009 | Nickel | 473/286 |
| 7,951,014 | B2 | 5/2011 | Nickel | |
| 2002/0022539 | A1 | 2/2002 | Smith et al. | |
| 2002/0147055 | A1 * | 10/2002 | French | 473/286 |
| 2004/0166955 | A1 * | 8/2004 | Nadratowski et al. | 473/286 |
| 2005/0181886 | A1 * | 8/2005 | Zmetra | 473/286 |
| 2005/0221908 | A1 * | 10/2005 | Gornall | 473/285 |
| 2007/0184913 | A1 | 8/2007 | Dunks | |

FOREIGN PATENT DOCUMENTS

| | | | |
|---|---|---|---|
| GB | 2479278 A | * | 10/2011 |
| JP | 2012050742 A | * | 3/2012 |

* cited by examiner

*Primary Examiner* — Stephen L. Blau
(74) *Attorney, Agent, or Firm* — Pedersen and Company, PLLC; Ken J. Pedersen; Barbara S. Pedersen

(57) ABSTRACT

A golf putter ball-marker handling system uses distance of a magnet from the marker to control whether the marker is captured or dropped. The golf putter preferably also has a ball-handling system that captures a ball in an aperture in the club head by sliding a ball-engagement pin into the aperture and underneath the ball. Both the marker-handling system and the ball-handling system are actuated at generally the same time by an actuation system that is controlled by a single handle at or near the club grip.

17 Claims, 16 Drawing Sheets

GOLF PUTTER WITH MARKER- AND BALL-HANDLING FEATURES

BACKGROUND OF THE INVENTION

1. Field of the Invention

The invention relates to a golf putter that reduces or eliminates the need for a user to bend or squat to place and lift a ball marker or to lift and replace a ball. More specifically, the preferred embodiment relates to a golf putter that comprises a marker placement and pickup feature and also a ball pick-up and placement feature. This way, a user who finds bending-over or squatting to be uncomfortable or difficult may play the putting portion of the game without leaving a generally upright standing posture.

2. Related Art

As is well-known in the game of golf, a golfer who has reached a green must often mark his ball location with a marker and lift his ball, and then, when other golfers in his group have putted, replace his ball and remove the marker before he begins to putt. This is according to rules and/or customs that allow the golfers, whose balls have fallen or rolled onto the green farther from the hole, to putt first; the closer balls. The closer balls may be an obstacle and are therefore marked and moved. These procedures require golfers to bend over and/or squat many times to reach the green to place and pick up the marker and ball. These actions become tiresome, painful, and/or difficult for many golfers, for example, older golfers, golfers with back injuries or pain, arthritis, or other problems or illness, or other people who simply prefer not to bend over or squat for various reasons.

The patent literature contains attempts to reduce the number of times a golfer must bend over during the game, and especially during the putting portion of the game. However, devices designed in an attempt to reduce the bending and squatting have traditionally required complex structure that results in operational difficulties and/or unattractive appearance, structure that is difficult to effectively operate, or structure that may damage golf course greens. Many of the devices require the marker to include a spike/pin extending from a surface of the marker and/or require a close fit between the marker and a pocket/slot in the device that results in difficult entry or exit of the marker from said pocket/slot. In other patents, the device is a separate apparatus that the golfer has to carry and use in addition to his conventional golf clubs/putter. Examples of devices from the patent literature, all of which have one or more of these problems, include U.S. Pat. No. 7,559,848 (Nickel), U.S. Pat. No. 7,086,971 (Zmetra), U.S. Pat. No. 7,059,971 (Scnmitt), U.S. Pat. No. 6,899,635 (Nadratowski, et al), U.S. Pat. No. 5,417,426 (Bayer), U.S. Pat. No. 5,310,177 (Conrad, et al.), U.S. Pat. No. 4,248,430 (Kepler), U.S. Pat. No. 4,017,082 (Channing, et al.), publication number 2007/0184913 (Dunks), 2002/0147055 (French), and 2002/0022539 (Smith, et al.).

Therefore, there is still a need for an effective device that reduces or eliminates the need for a golfer to bend over or squat to reach and manipulate a marker and/or ball on a golf course. Certain embodiments of the invented apparatus and methods solve some or all of the problems of previous devices, as will be apparent from the following summary, detailed description, and the attached drawings.

SUMMARY OF INVENTION

The invention comprises a golf putter that comprises a ball-marker handling system adapted for placement of a marker on the green and also for retrieval of the marker from the green. Preferred embodiments also comprise a ball-handling system adapted for retrieval and placement of the user's ball. The ball-marker handling system and ball-handling systems may be located at opposite ends of the club, but are more preferably both located at the putting head end of the club.

The preferred ball-marker handling system comprises a magnet that is located at/near the putter head to hold the marker on the bottom surface of the head, preferably in a recess in said bottom surface. The magnet holds the marker in said recess unless the magnet is moved relative to the head to distance the magnet from the marker, whereby the magnet's attraction of the marker is lessened and the marker is released. Thus, the magnet may be called a "moving magnet" as it moves relative to the head and the shaft of the club during at least some steps of operation.

For certain embodiments wherein the marker-handling system and the ball-handling system are at opposite ends of the club, the handles controlling said systems may be located at opposite ends of the system, with each handle being distanced from its respective system a substantial amount of the length of the club. This way, the club may be turned/flipped generally 180 degrees to place a given system, that is, the system needed at the time, on or near the green/course. With the needed system thus-pointed generally downward the handle that controls said needed system is located at/near the upper end of the club for easy reach and operation without the user bending-over or squatting.

For certain embodiments wherein the ball-handling system and the marker-handling system are at the same end of the club, the handle(s) controlling said systems are preferably opposite said systems at or near the grip-end of the club. This way, the club need not be turned/flipped, because the handle(s) is/are located at/near the upper end of the club, distanced from the green/course, for easy reach and operation without the user bending-over or squatting.

These and/or other features or objects will become apparent to those of skill in the art, after reviewing the following description and drawings.

DETAILED DESCRIPTION OF THE PREFERRED EMBODIMENTS

Figure 1:
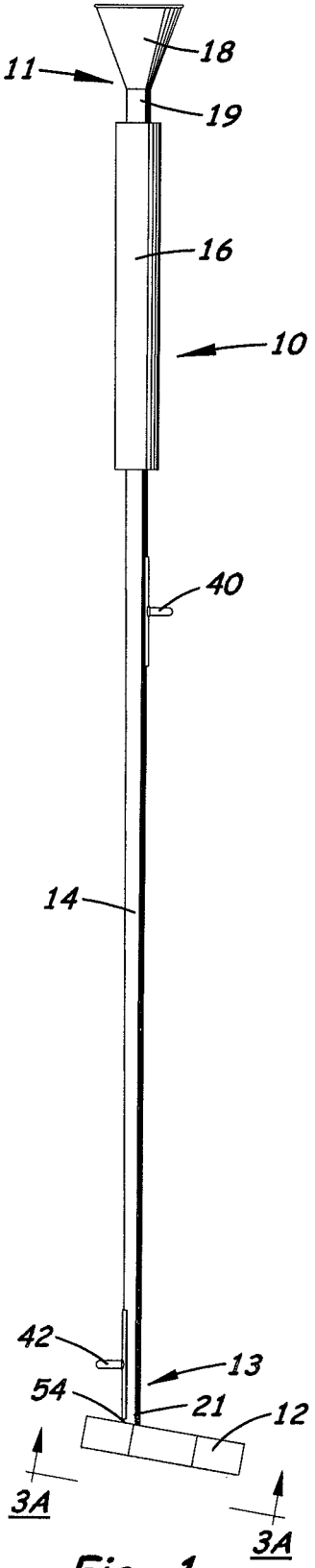
FIG. 1 is a side view of one embodiment of the invented golf club with embodiments of marker- and ball-handling systems that are at opposite ends of the club.
Figure 2:
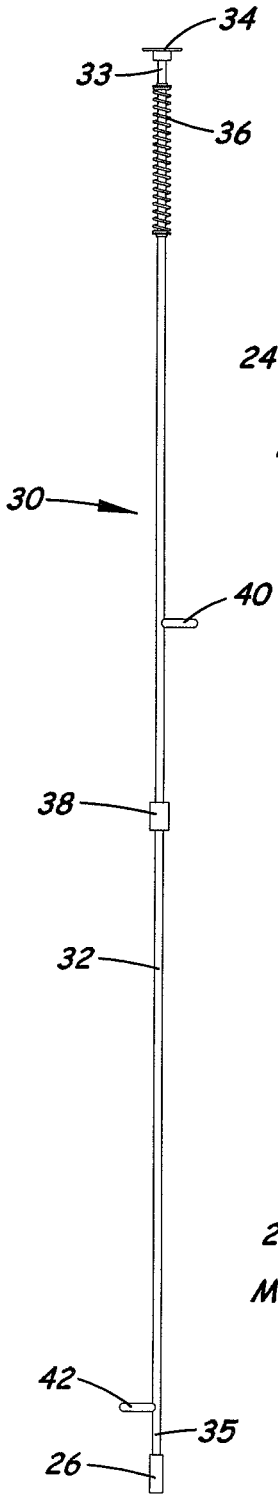
FIG. 2 is a side view of the sliding assembly that adapts the golf club of FIG. 1 for said marker and ball handling.

Referring to the figures, there are shown several, but not the only, embodiments of the invented golf putter. FIGS. 1-3 show one embodiment of a putter, its interior components, and details of the putting head and an example marker, wherein the marker-handling and ball-handling systems are located at opposite ends of the club. FIGS. 4-14 show the putter of FIGS. 1-3 in use, and include cross-sectional portions, to illustrate the movement of the internals of the putter. FIGS. 15-31 show another putter embodiment, which comprises both a marker-handling system and a ball-handling system at the head-end of the putter, and with a single actuation handle at the opposing end of the putter. FIGS. 32-38 show another embodiment of a putter head comprising both marker- and ball-handling systems, wherein the head has alternative head surfaces and contours. It may be noted that clubs within the scope of the invention may be adapted to be right-handed or left-handed as will be understood by those of skill in the art. It may be noted that most of the figures show only one or both ends of the club, to allow enlargement and better viewing of details of said ends. It may be noted that the preferred embodiments operate with magnetic, conventionally-shaped markers that do not include any spike or pin that extends into the ground, but instead are preferably flat and circular, for example, a coin, a disc, or other coin/disk shape.

Exemplary Embodiment Having Ball-Handling and Marker-Handling Systems at Opposite Ends of Club.

FIG. 1 is a side view of a putter having an appearance similar to many conventional putters, except for the generally conical ball-retriever on the grip-end of the club, and the two small handles near the putter head and the grip, respectively. Many different styles and constructions of putters may be adapted to comprise embodiments of the preferred systems, for example, different shapes and sizes of putter heads, different connection points of the shaft to the head, different styles and lengths of grip, and different materials for the club. In this embodiment, the shaft of the club is straight and linear, so that a straight rod sliding inside the shaft may actuate at least the marker-handling system. This shaft is attached to the head at an angle, so that the shaft extends comfortably into the golfer's hands when the golfer is standing in normal putting stance beside the ball. However, alternative actuators may be effective for moving the magnet, and, hence, non-straight, non-linear shafts may also be used in certain embodiments. For example, see the non-straight shaft of the embodiment of FIG. 15, wherein a flexible actuator rod 132 is sufficiently bendable as it slides through the shaft, to accommodate one or more bends of the club shaft. Shafts other than those shown in the drawings may be used, such as a double-bend shaft or other conventional shaft shapes, with the internals being adapted to bend/curve appropriately.

The golf club 10 for putting is shown in FIG. 1 in a generally vertical orientation, wherein the putter head 12 is pointed downward, the shaft 14 is vertical, and the end comprising the grip 16 is pointed upward. In FIG. 1, the ball-handling system 11 is at the top of the club and the marker-handling system 13 is at the bottom of the club. Above the grip 16 in FIG. 1 may be seen the ball-retriever cup 18 at or near the first end 19 of the club, which is generally conical and hollow and protrudes away from the center of the club, for example, a few inches beyond the grip surface. At the opposite end of the club from the grip 16 and ball-retriever cup 18, that is that second end 21 of the club, is the head 12 with its bottom surface 20, and the magnet 26 (FIG. 2) that is instrumental in marker-handling. The operation of the ball-handling system, of which the cup 18 is an important portion, and operation of the marker-handling system, of which magnet 26 is an important portion, will be discussed in detail below.

As will be known by those familiar with golfing, the grip 16 held typically in both of a user's hands, with the head 12 on or near the surface of the green. The green is typically very short and carefully-groomed grass so that it forms a generally horizontal surface. The club shaft 14 typically is slightly inclined, for example, at about 10-30 degrees from vertical, to move the head 12 out from the user's feet. This way, the user may perform the putting stroke, which comprises what may be called a short or partial swing, for example, about 10-45 degrees rearward from the ball, towards the ball to strike the ball, and then some follow-through. With the shaft thus-slanted outward from the user's hands to the ball, the bottom surface 20 of the putter head 12 will preferably be generally parallel with the green surface, that is, generally horizontal.

Club 10 has an internal actuation assembly 30, which is shown to best advantage in FIG. 2 in the orientation in which it would reside when inside the golf club. The assembly 30 is elongated and substantially fits inside the interior space 31 of the golf club 10. The assembly 30 comprises assembly rod 32, with is smaller in diameter than the smallest diameter of the club shaft 14. The assembly 30 also comprises a ball-ejector 34 at a first end 33 of the assembly 30, which impacts/pushes the ball out of the ball-retriever cup 18 when desired by the user. Spring 36 biases the entire assembly 30 in the opposite direction from the ball-ejector 34, that is, toward the lower end of FIG. 2, which is the head-end or second end 35 of the assembly.

The club shaft diameter of most putters is tapered from a larger diameter near the grip to a smaller diameter near the head. The assembly 30 is adapted to remain centered or generally centered inside the shaft 14 in spite of the change of diameter of the shaft 14 in which it slides. The first end 33 of the assembly is typically centered in the larger-diameter interior space of the shaft by the first end 33 of the rod 32 extending through a hole in a radial (transverse) plate 37 (see FIG. 7) that is at the central longitudinal axis of the shaft 14. This way, the plate 37 keeps the first end 33 of assembly rod 32 centered in shaft 14, that is, coaxial with shaft 14. Also, as will be apparent when viewing FIG. 7, plate 37 also serves as an abutment plate against which spring 36 is compressed.

The opposite end, that is, the second end 35, of the assembly 30 is in the small-diameter interior space 31 of the club shaft 14, and the magnet 26 may be sized so that its outer diameter generally matches the inner diameter of club shaft 14 at the point in the shaft 14 where the magnet will slide. Thus, the magnet 26 keeps the rod 32 centered in shaft 14, that is, coaxial with shaft 14. Alternatively, the magnet may be fixed to, or embedded in, a magnet housing or holder at or near the end of rod 32. In certain embodiments, the housing/holder outer diameter would generally match the inner diameter of the club shaft 14, so that the housing/holder would slide in the bore 25 to move the magnet to the desired positions as described elsewhere in this document. In such embodiments, the magnet might be embedded in a lower end of the housing so that the magnet would be exposed at, or very near, the lowermost end of the housing/holder.

The middle region of the rod 32 is preferably kept centered or generally centered in the shaft 14 by spacer 38. Spacer 38 may slide along the assembly rod 32, and when the club 10 and assembly 30 are in the orientation in FIGS. 1 and 2, spacer 38 slides down inside the hollow interior space 31 of shaft 14 until it reaches a place in the shaft 14 where the spacer outer diameter matches the inner diameter of the club shaft 14. The spacer 38 will slide downward until it becomes wedged or at least snugly received in the shaft 14. In this position, the spacer provides stability to the middle region of the rod 32 by keeping the middle region of the rod 32 centered and not wobbling inside the club shaft 14. The spacer 38 is preferably a polymeric or other non-metallic material(s), and is sized to roughly match the inner diameter of the club shaft 14 when it is approximately in the roughly middle-of-the-shaft position along the rod 32 shown in the FIG. 2. When the spacer is wedged/snug, it will help smooth and quiet operation of the assembly rod 32, by keeping the middle region of rod 32 coaxial with the club shaft 14.

When the club is turned/flipped generally 180 degrees to place the head 12 upward and the grip 16 downward, the spacer 38 may slide a few inches toward the first end of the assembly 30 until it impacts handle 40 that protrudes radially out from the rod 32. In this position, the spacer outer diameter will probably be smaller than the inner diameter of the assembly rod 32, but will still be close to said inner diameter, for example, within about 1/16-1/3 of an inch of said inner diameter. Thus, the middle region of the rod 32 might at most move a small amount away from being coaxial with the club shaft but not far enough to cause poor operation of the assembly. And, even if the middle region moves off-center to an extent that the spacer touches the inner surface of shaft 14, the non-metallic spacer 38 will not make significant noise upon or during said contact.

Handles 40 and 42 protrude out from the rod 32 in a radial direction to be accessible to the user, that is, transversely to the longitudinal axis of the club 10 or assembly 30, as seen in FIG. 1. In the preferred embodiment, the handles protrude in opposite directions from rod 32, but may protrude in other directions including the same direction. Handle 42 may be more easily accessed by the user if it protrudes away from the direction in which the major portion of the putter head 12 extends from the shaft.

Figure 7:
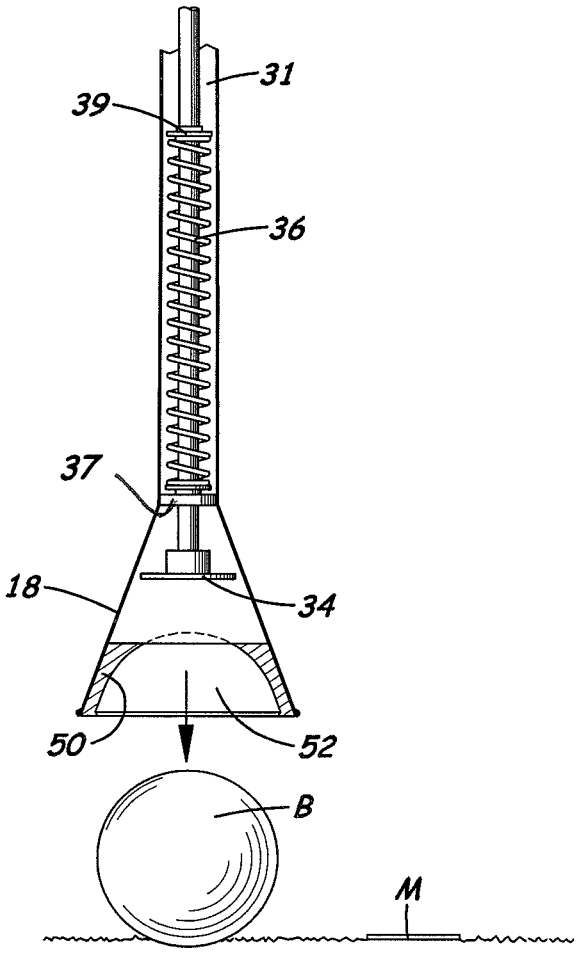
FIG. 7 is a side view of the golf club of FIG. 1, flipped end-to-end from its position in FIGS. 1, 4 and 5, to push the ball-retrieval cup down over the ball to capture the ball in the cup.

The assembly 30 is installed in the club 10, with the rod 32 extending through a hole in plate 37, with one end of the spring 36 pressing against the plate 37 and the other end of the spring 36 being fixed to the rod 32 at connection 39 (FIG. 7). As mentioned above, the magnet (or magnet housing/holder in alternative embodiments) may be roughly the same diameter as the inner space of the second end 21 of the shaft 14, and the spacer 38 helps stabilize the middle region of the rod 32 in the club. The assembly 30 slides longitudinally (axially) relative to the club, upon the handles being pushed longitudinally (axially) either toward the grip end or the head end of the club. In the preferred operation, the timing and direction of handle movement is specially adapted to operate the systems of the club in desired and optimized ways, and will be discussed below.

Figure 3A:
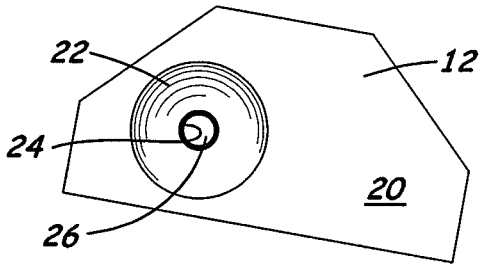
FIG. 3A is a bottom view of the bottom of the head of the FIG. 1 golf club.
Figure 3B:
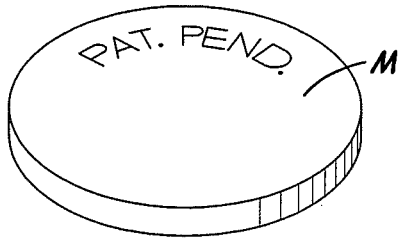
FIG. 3B is a perspective view of an example ball marker, wherein the opposite side (not shown) is a mirror image of the visible side and has no spike or protrusion to be pushed into the ground.
Figure 3C:
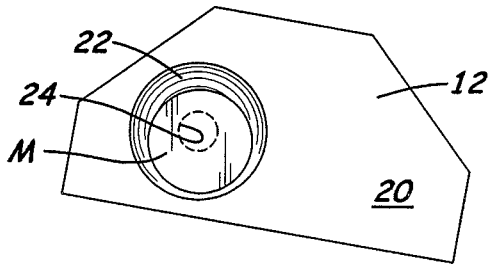
FIG. 3C is a bottom view of the head as in FIG. 3A, wherein the marker of FIG. 3B has been attracted and held in the recess of the bottom surface of the head.

FIG. 3A portrays the bottom surface 20 of the head 12, and recess 22 in the bottom surface 20. A bore 25 (see FIG. 5) is provided through the head 12 that is preferably open to the interior space of the shaft 14, and is also coaxial with and preferably the same diameter as said interior space of the shaft 14 at the second end 21 of the shaft 14. The bore 25 through the head 12 is defined by bore surface 24, shown in FIG. 3A, and is preferably centered in a recess 22 in bottom surface 20. When the handles are not being operated, the spring biases the assembly 30 to a position wherein the assembly 30 and its magnet 26 are urged to toward the head-end (second end 21) of the club. In this position, magnet 26 extends into the bore 25 of the head 12 and its end is at or near the same plane as the bottom (trough) of the recess 22. This places the magnet 26 in a position relative to the bottom surface 20 and recess 22 wherein the magnet will certainly attract the marker M to it, when the marker comprises a magnetic material. FIG. 3C portrays the bottom of the head 12, with a marker attracted and captured by the magnet 26 (in dashed lines in FIG. 3C to show the magnet 26 location). The recess is made of such a depth that the marker M is held by the magnet on or near the bottom surface of the recess 22, and the marker is deeper in the head than the plane of the major portion of the bottom surface 20 of the head. In other words, the marker M is inside the recess and is preferably of a thickness that it does not protrude out from the head past the plane of the non-recessed portion of the bottom surface 20. This way, the marker does not interfere with putting and is not scrapped off the putter head during putting. The operation of the marker-handling system, and the importance of the magnet and marker positions, will become apparent from the further description below.

One may notice in FIG. 3C that the recess 22 is preferably circular, and that marker M in FIG. 3C is not perfectly centered in the recess 22. The recess 22 diameter is preferably larger than the diameter of the marker M, for example, 10-80 percent, more preferably 20-70 percent, and most preferably 20-50 percent, larger in diameter than the marker. The recess 22 preferably is large enough to have extra room around the marker in all directions so that the marker need not be closely or tightly surrounded by the structure of the head. The wall of the recess is curved from the outer perimeter edge of the recess to the center of the recess, which, because the bore 25 opens to the recess, is the center of the bore. In certain embodiments, this curvature of the recess wall may allow the marker M to be attracted into nearly any portion of the recess, depending on how accurately the head 12 is placed over the marker M. In certain embodiments, the attraction to the magnet may cause the marker to slide toward the center of the recess to be generally, but not necessarily exactly, centered the over the bore and the magnet.

It may be noted that the bore 25 preferably opens to the recess, but instead in certain embodiments, the bore may be closed to the recess, for example, by a preferably thin wall that is the recess wall. This may be done, depending on the strength of the magnet and how close it must come to the marker, and whether it must be exposed, to attract the marker into the recess.

Figure 4:
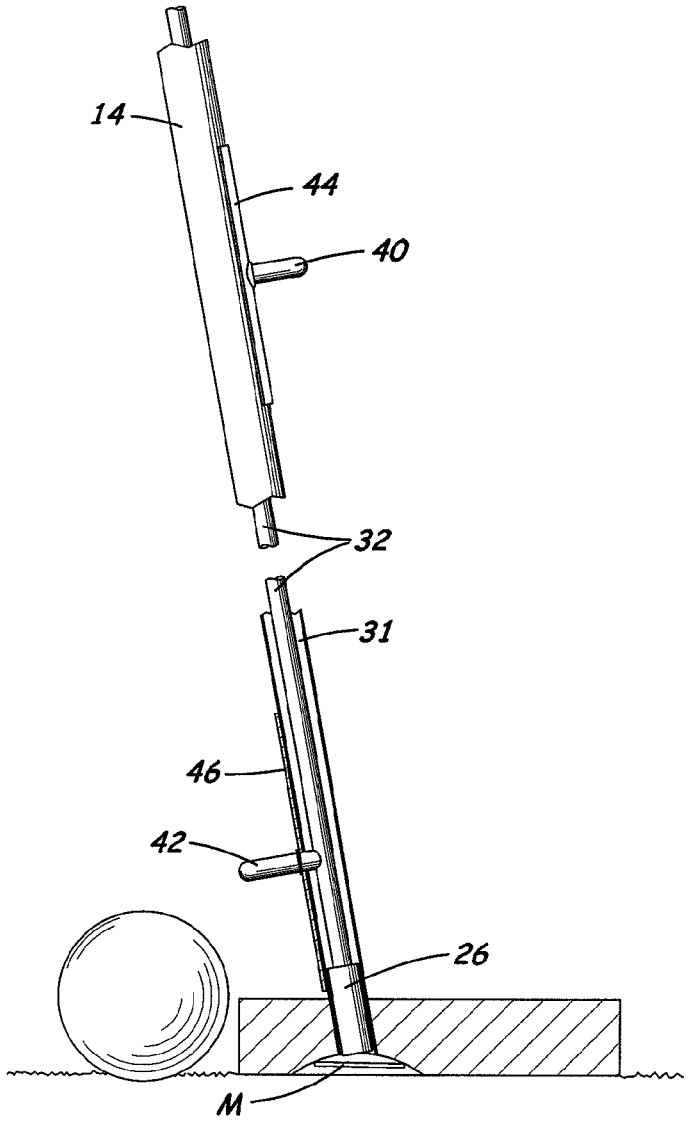
FIG. 4 is a side view of the golf club in FIG. 1, partially in cross-section, being used to place the golf club head near a ball on a green, wherein the head holds a ball-marker by magnetic attraction of the marker to a magnet.

FIG. 4 portrays the first step in certain methods of using the golf club 10. Once the order of putting is determined, typically by relative position of the balls on the green to the hole, golfers closer to the hole will need to mark the location of their balls and lift the balls up off the green. As in FIG. 4, the user of the club 10 will place the head 12 down on the green beside the ball, with bottom surface optionally gently pressed against the grass and with the marker already in place held inside the recess 22 by the magnet 26. The marker M is held in the recess preferably only by the magnetic field of magnet M, which is not an electromagnet. The marker M is preferably not held in the recess by any lip, clip, flexible member, ledge, pocket, or other member extending over or closely-around the marker. It is simply held by the magnet and, preferably, by only one magnet that is coaxial with the rod 32 and shaft 14 and bore 25.

To release the marker M, the user pulls handle 40, which is at the upper end of the club in this figure and near the user's hands, when the user is standing up, without the user needing to bend or squat. This movement of handle 40 will move the entire assembly 30, including the magnet 26, upward in FIG. 5. The magnet is thus pulled up in the bore 25 to an extent wherein the magnetic field of the magnet 26 no longer attracts the marker M sufficiently to hold the marker M in the recess 22. Therefore, the marker M falls to the green G. These actions take place, preferably, without movement of the head 12 relative to the green, and without such a movement of the head being needed to release the marker M. Therefore, it may be said that "scraping" the marker M off the bottom or out of the recess 22 is not done to remove the marker from the head 12. In fact, when the head 12 is placed on the green, the marker M, being in the recess, will typically not contact the green. Also, the release of the marker preferably does not comprise any electronic or electric means, for example, no turning on or off, or switching, of an electrical current.

The location of the marker M in the recess in FIG. 4, until the magnet 26 is pulled away from the recess and marker, also allows the user to putt with the marker in place in the recess, if desired. Some golfers will thus "store" the marker in the recess until use. Others will place the marker in the recess just before flipping the putter to the position as in FIG. 4. It may be noted that the magnet will normally be in a proper position in the bore to capture the marker, without any operation of the handles 40, 42, so the user installing the marker need only place the marker close to magnet and the marker will "jump" into place in the recess. The user will not have to operate any handle 40, 42 to install the marker. As shown in FIG. 6, once the marker is dropped to the green G according to the method of FIGS. 4 and 5, the marker will rest on the green G near the user's ball B and the head 12 may be moved away.

Figure 8:
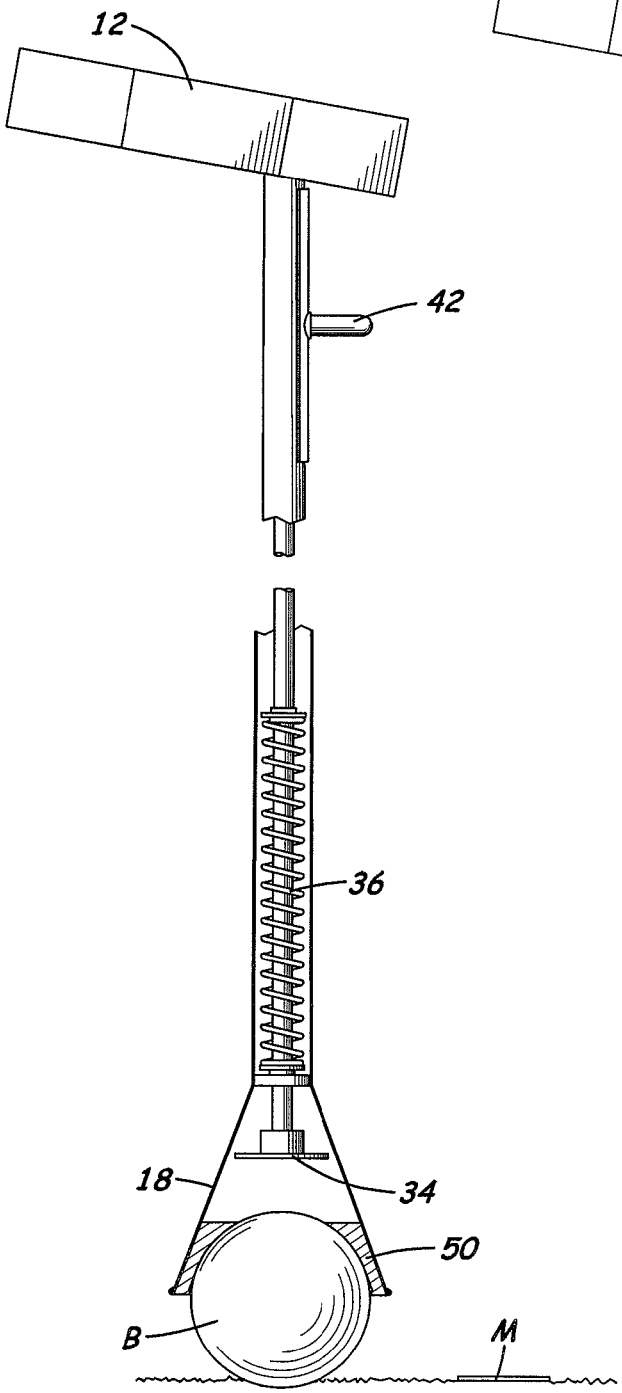
FIG. 8 is a side view of the golf club of FIG. 1, having captured the ball, and ready for the user to lift the ball up off the green. This view is also representative of the golf club orientation, after the other golfer's have taken their turn(s), and the user has set the ball on the green again, getting ready to replace the ball for his putt.

The next step is turning/flipping club 10 about 180 degrees, to point the first end of the club downward near the green and over the ball B, as shown in FIG. 7. The ball-retrieval cup 18 is pushed down over the ball B to the extent that the opening of the cup 18 surrounds a portion of the ball, as shown in FIG. 8. The cup 18 will typically have a liner 50 wherein the liner material and/or interior surface shape and size tends to grip the ball. This gripping may comprise capturing the ball by 1) surrounding approximately the upper half of the ball and having a rubbery interior surface that tends to grip the ball, 2) surrounding slightly more than the upper half of the ball (slightly snapping around and below the equator of the ball), and/or 3) affecting suction on the ball to an extent that will help hold the ball in the cup. One or more of these effects will allow the user to pick up the ball in the cup 18 without bending over or squatting to grab the ball. Then, the user will step away, carrying the ball away in the cup, so that other golfers may putt. One may note that, in the entire ball-picking-up process, the assembly 30 and its handles 40, 42 are not operated. The spring 36 biases the assembly 30 away from the cup 18, so there is room in the cup to receive and carry the ball. The cup space 52 for receiving the ball is considered the space that the ball occupies when it is captures, including in this embodiment the space surrounded by the liner 50 and also the area above the liner 50 in FIG. 7 (dashed lines) where the innermost portion of the ball will extend.

Figure 9:
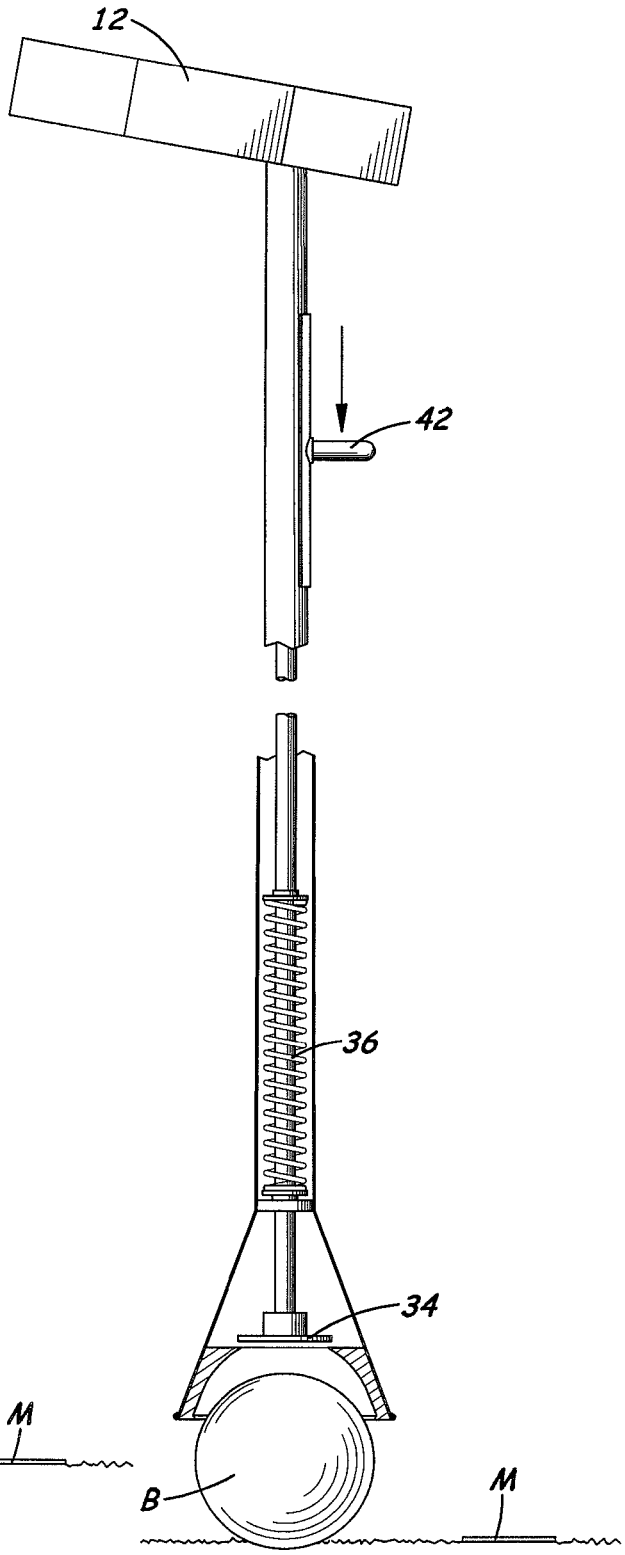
FIG. 9 is a side view of the golf club of FIG. 1, oriented generally as in FIG. 8, but after the user has pushed the second handle to move an ejector member into the interior space of the cup, so that the ball has been ejected from the cup onto the green again for the user's putt.
Figure 10:
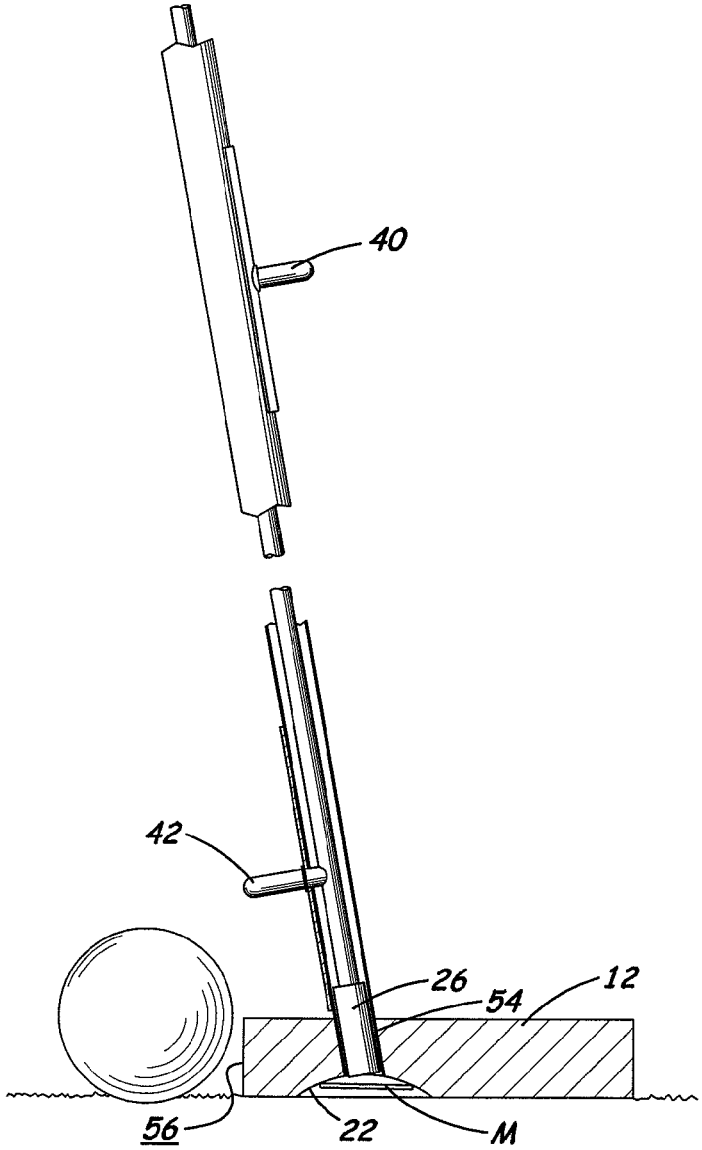
FIG. 10 is a side view of the golf club of FIG. 1 after replacement of the ball on the green, placed adjacent to the ball and after the proximity of the magnet to the marker has attracted the marker to "hop" or "jump" up into the recess of the club toward the magnet, whereby the marker is captured without any manipulation of the handles or any other portion of the sliding assembly.

When it is time for the user to putt, he/she will bring the club with captured ball back to the location beside the marker M, to replace the ball. As shown in FIG. 9, the user will press handle 42, which is near the upper end of the club so that the user may still stand up erect without the need to bend or squat to any extent. By pressing handle 42, the entire assembly 30 is moved downward toward the ball and green, and the ball-ejector 34 moves to a location where it touches and pushes the ball down out of the cup, for example, the ball-ejector 34 moves into the cup space 52. Thus ejected, the ball will lie beside the marker, at or close to the position where it started before being picked up. It may be noted that the ball-ejector member drawn for club 10 is a transverse (radial) plate, but the ejector member may be other shapes, for example, a small shallow cup, a broad cylinder or other shapes that will push the ball out of the cup without damaging the ball.

Figure 11:
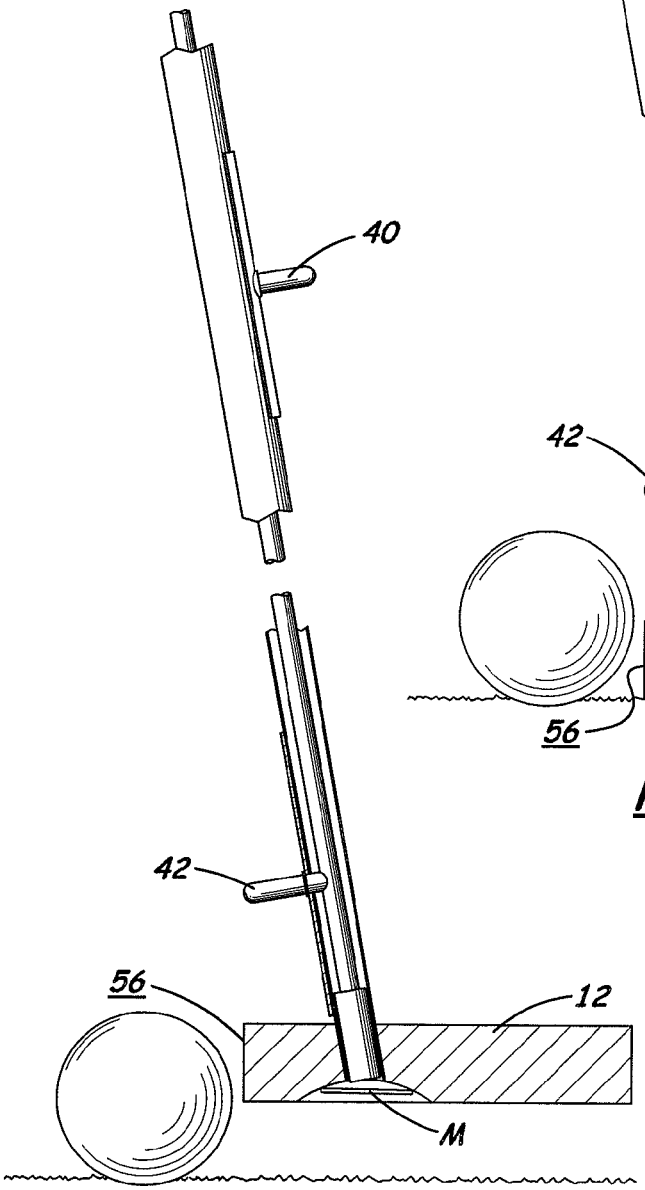
FIG. 11 is a side view of the golf club of FIG. 1, shown as the user raises the club away from the green, with the marker still captured.

With the ball back in place, the user will again turn/flip the club about 180 degrees, to place the putter head 12 down on the green in a position that the user approximates will place the magnet 26 over the marker M. With the bottom of the magnet close to the marker, the magnet 26 attracts the marker to "hop" or "jump" up into the recess 22, for example, as in FIG. 10. With the marker thus held by the magnet, the marker is removed from the green and held in the recess inward in the head relative to the plane of the bottom surface 20 of the head, as shown in FIG. 11. The user may then proceed to putt, with the marker still held in the recess, as the marker will not interfere with a smooth movement of the head on or above the green.

Alternatively, if the user prefers, he/she may grab and pocket, or otherwise store, the marker prior to putting. Removing the marker from the head for storage separate from the club need not require operation of either of the handle. Removal may be done by flipping the club so that the user can easily reach the bottom of the head, grasping an edge of the marker, or pushing the marker sideways out of the recess until the edge of the marker is graspable, and then manually removing the marker from the head.

Figure 12A:
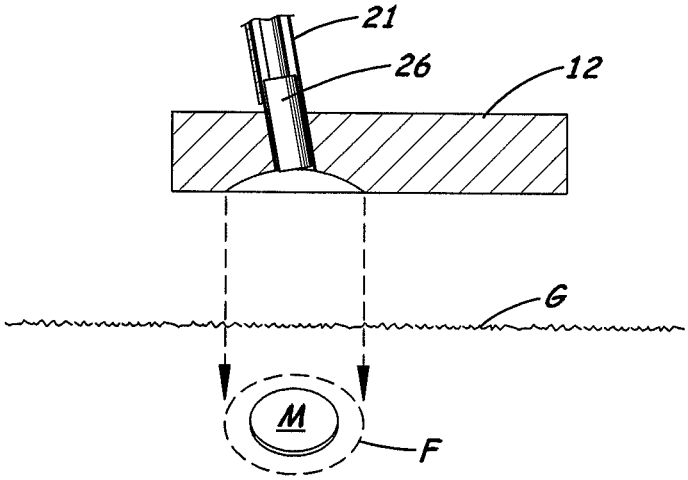
FIG. 12A is a partially-cross-sectional side view of the head with marker-handling system, of the club of FIG. 1, wherein the footprint of the recess in the head is entirely over the marker.
Figure 12B:
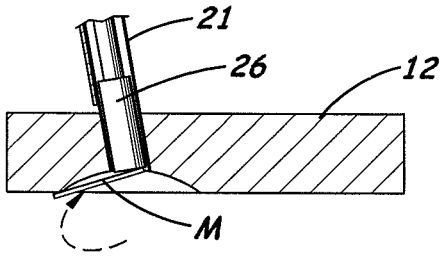
FIG. 12B is a partially-cross-sectional side view of the head of the club of FIG. 1 wherein the marker is in the process of being attracted and captured in the recess, wherein the marker is sliding slightly toward a more-centered position due to the curved wall of the recess.
Figure 12C:
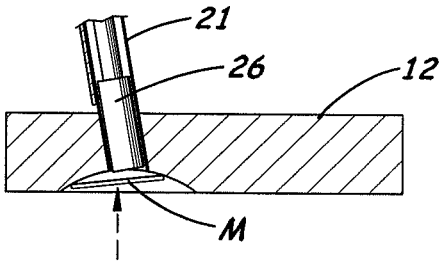
FIG. 12C is a partially-cross-sectional side view of the head with marker-handling system, wherein the marker has been attracted straight up and captured in the recess, in an off-center position but still entirely within the recess.
Figure 12D:
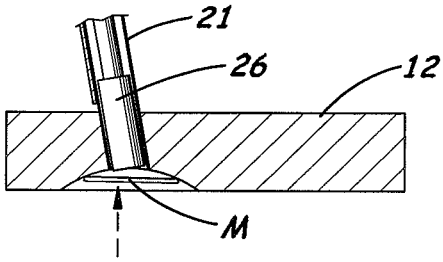
FIG. 12D is a partially-cross-sectional side view of the head with marker-handling system, wherein the marker has been attracted straight up and captured in the recess, in a centered position and entirely within the recess.

In certain embodiments, the magnet strength and location and the size of the recess relative to the marker are chosen so that the marker only "jumps" into the recess when the recess is "directly over the marker" or "entirely over the marker". This means that the recess need not be placed perfectly-centered over the marker in order to pick it up from the green, but at least "directly" over the marker, that is, so that the footprint F of the recess outer perimeter (vertically downward toward the green when the head is horizontal) is around the entire marker, that is, horizontally outside the entire perimeter of the marker, as shown in FIG. 12A. In such embodiments, the magnet will preferably not attract the marker sufficiently for it to "jump" up into the recess until the recess is thus "directly" over the marker. There is some leeway in placement of the head over the marker M, however, because the recess outer perimeter (and hence its footprint) is preferably significantly larger diameter than the marker. Therefore, in such embodiments, the magnet is preferably strong enough that it will attract the marker so that it hops or slides entirely into the recess when the marker starts in the locations shown in FIGS. 12 B-D, for example, where the recess footprint is over most of the marker (FIG. 12B), entirely over the marker but not centered (FIG. 12C), and entirely over and centered over the marker (FIG. 12D). In certain embodiments, therefore, the magnet will be designed so that it will cause a marker to slide entirely into the recess when the footprint is over at least 85 percent, at least 90 percent, at least 95 percent, or at least 98 percent of the marker, due to the curved wall of the recess 22. If the head is not, at first, accurately placed with the recess 22 directly over the marker, some sideways movement/waving of the head, in certain embodiments, will place the recess directly over the marker and allow the magnet to pick up the marker properly. "Picking up the marker properly" means in these embodiments that the marker is held against the bottom surface of the recess and received entirely inside the recess.

Figure 13A:
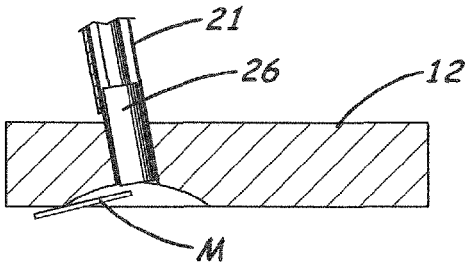
FIGS. 13A and B are partially-cross-sectional side views of the head of FIG. 1, wherein placement of the marker-handling system relative to the marker is undesirable as the recess footprint surrounds too little of the marker, so that the magnet is too distant from the marker and typically will not attract the marker to a sufficient extent to move the marker into the recess.
Figure 13B:
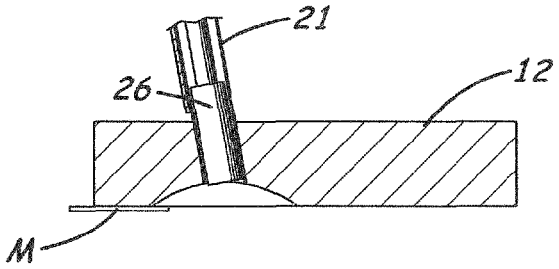

The magnet is preferably not so strong that it will attract the marker from positions wherein the marker is substantially outside of the recess, or so strong that it will hold the marker to the putter surface outside the recess (see FIGS. 13A and B, for example). Positions of the marker such as shown in FIGS. 13A and B are not preferred, as they may result in less precise control of the marker and/or a marker being held on the bottom of the head in a position that would interfere with putting unless the marker is removed.

Figure 5:
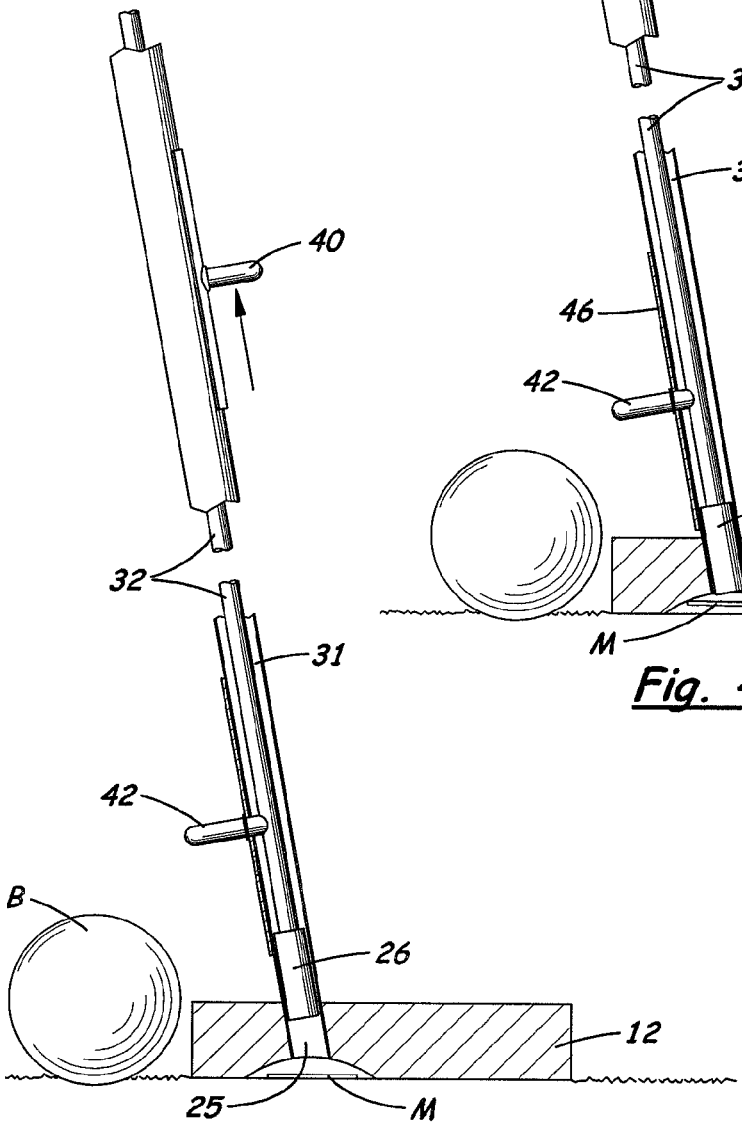
FIG. 5 is a side view of the golf club of FIG. 1, wherein a handle has been pulled upward to distance the magnet from the marker so that the marker has dropped.
Figure 6:
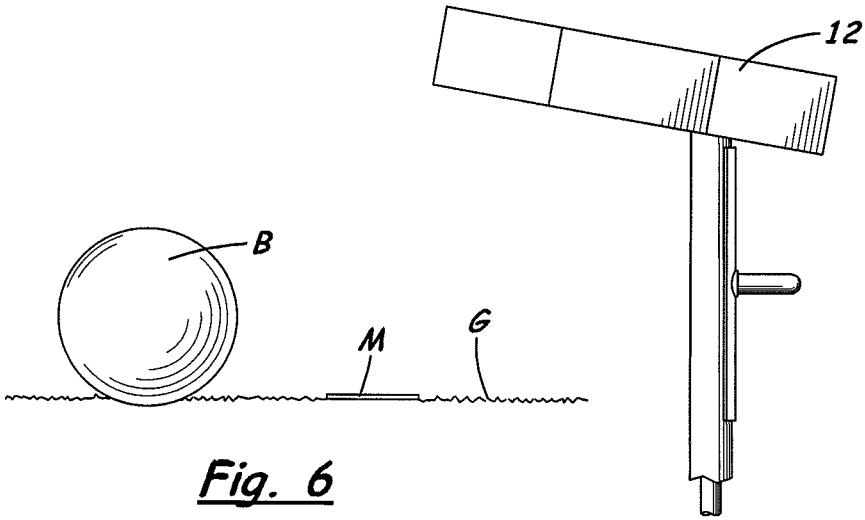
FIG. 6 is a side view of the ball and marker on the green, after the golf club has been removed from its position in FIG. 5.

It should be noted that the connection 54 and/or the dimensions of the putter head 12 serve to guide the user in placement of the marker in the first place, that is, in FIGS. 4 and 5. The head 12 may be placed conveniently next to the ball, for ejection of the marker, and, when the ball is to be replaced, the user will be able to estimate an accurate replacement for the ball, for example, based on the distance from the connection 54 to the end surface 56 of the head 12.

As may be understood from the above description of the preferred methods of using the putter, the user may accomplish all these steps without bending or squatting at all or at least not to a significant extent. The apparatus that adapts the golf club to accomplish these steps changes the appearance of the club only a little, for example, by providing two handles 40, 42 that protrude out from the shaft and by providing the cup 18 at the grip-end of the club. The bottom of the head 12 changes because of the recess 22 and optionally the bore 25 (if it is open to the recess), but these is also minor changes in the general appearance of the club. Also, the adaptations to the club to accomplish the preferred methods are done with a fairly simple actuation assembly 30, which has a single internal rod that allows operation of both the marker-handling system and the ball-handling system.

Figure 14A:
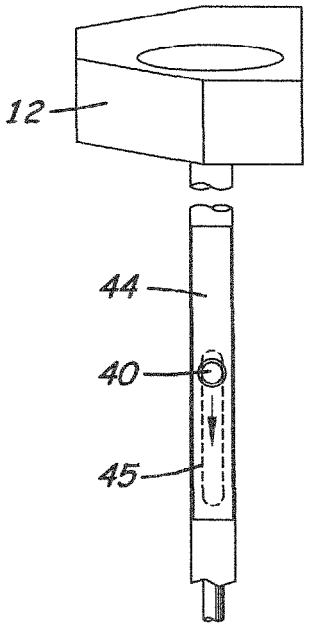
FIG. 14A is a side view of a portion of the club of FIGS. 1-13, showing the handle system for the marker-handling system and the aperture in the club shaft that allows axial movement of the handle toward the grip end of the club.
Figure 14B:
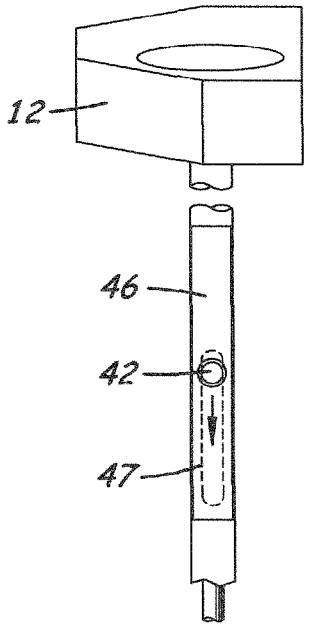
FIG. 14B is a side view of a portion of the club of FIGS. 1-13, showing the handle system for the ball-handling system and the aperture in the club shaft that allows axial movement of the handle, wherein this figure portrays that this handle will be moved in the same direction (toward the grip end of the club) as the handle for the marker-handling system in FIG. 14A.
Figure 15:
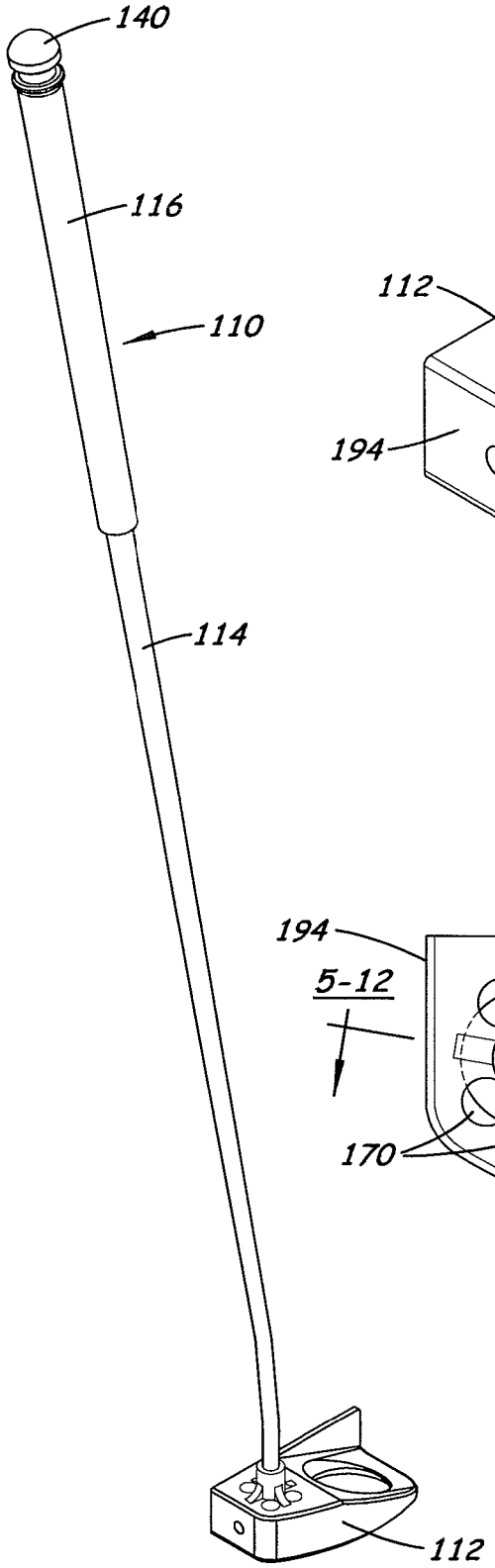
FIG. 15 is a side perspective view of an alternative club, which has a marker-handing system and a ball-handling system at the same end of the club.

As shown in FIGS. 14A and B, the handles 40, 42 each protrude through an elongated slot 45, 47 in the shaft 14 that each extends a length at least equal to the distance the handles will travel when pressed and then released. Handle plates 44, 46 may be provided to cover the slots and travel with the handles 40, 42, respectively, to provide a sleeker appearance for the side of the shaft 14 and to help prevent pinching of the user's fingers/thumbs. From FIGS. 5, 9, and 14A and B, it may be understood that the assembly 30 rests in a resting-position prior to actuation of either of the handles, where the magnet is closest to the recess, and the ejector member 34 is farthest from the cup 18. Then, when either of the handles 40, 42 is moved, to actuate either dropping of the marker or ejection of the ball, the assembly 30 moves the same direction, that is, away from the putter head into the ejection-position. This ejection-position is so-called because it will either actively eject the ball from the cup, or passively allow the marker to fall away from the head, thus "ejecting" the marker. One may see, therefore, the handles 40, 42 in the resting-position in FIGS. 14A and B, wherein they are in the portion of their respective slots 45, 47 toward the right side of the drawings; if either of the handles is actuated by pushing or pulling, they will both move toward the left of the page relative to their respective slots 45, 47, with equates to upward in FIG. 5 and downward in FIG. 9 due to the orientations of the club in FIGS. 5 and 9.

Certain Embodiment having Marker-Handling and Ball-Handling Systems at the Same End of Putter.

FIGS. 15-38 portray two embodiments 110, 212 wherein both the marker-handling and ball-handling systems are located at or near the same end of the club, and a single handle located at or near the opposite end of the club is used to operate both systems. The marker-handling system of club 110, like club 10, comprises a moving magnet. The ball-handling system of club 110, unlike the grip-end cup 18 of club 10, comprises an aperture in the club head and a pin assembly that retains the ball in the aperture. In these embodiments, actuation of the single handle simultaneously operates elements of both the marker- and ball-handling systems.

The synergistic design and operation of certain embodiments allows pulling/pushing of a single handle ("plunger") of an actuation assembly to actuate both the marker- and ball-handling systems, with these two systems having some elements in common and/or that cooperate together to perform their functions. This way, the club need not be flipped/rotated for marker- or ball-handling, and a simple and efficient structure and operation is achieved.

It is preferred that the actuation assembly is housed and supported so that, when the user pulls or pushes its handle to the desired pulled-position (away from the head) or pushed-position (toward the head), respectively, the assembly (130) will stay in that position until the user purposely applies force in the opposite direction. This may mean that no biasing system is applied to the assembly to urge the assembly into one position or the other. Bushings and/or other structure apply appropriate resistance to hold the actuation assembly in the desired position until the user purposely moves the actuation assembly. Said appropriate resistance prevents the actuation assembly from rattling and from sliding unless manually moved by the user. A spring or other bias may be used as a part of the ball-handling system, but this does not bias the entire actuation assembly.

More specifically referring to FIGS. 15-30, club 110 comprises head 112, shaft 114, grip 116, ball-handling system 111, marker-handling system 113, and actuation assembly 130 for operating both systems 111 and 113, wherein systems 111, 113, and 130 have elements in common and/or that cooperate. The actuation assembly 130 comprises manually-operated plunger 140 with a knob-style handle, upper bushing 142 at the grip-end of the assembly 130, actuator rod 132 (similar to rod 32 in club 10), sheath 144, lower bushing 146, and magnet unit 156. Of these elements, the plunger 140, rod 132, and magnet unit 156 slide in the longitudinal bore 131 of the shaft 114, while the upper and lower bushings 142, 146 and the sheath 144 remain fixed relative to the shaft 114. Ball-handling system 111 comprises pin assembly 165 (ball-retention pin 160, ball-bearing 162, and spring 164), slidably received in bore 166 and cooperating with magnet unit 156 and ball-receiving aperture 180. For embodiments comprising a ball-scooping function, the ball-handling system 111 may be said to further comprise ball-scooping surface 195. Magnet-handling system 133 comprises said magnet unit 156, which slides in the bore of the head 112 and toward and away from recess 122 in the bottom of the club. Sight-holes 170 through head 112 may be considered an element of the marker-handling system 113, as they allow the user to see the marker through the head.

From the drawings and the description below, it easily may be understood that, in certain embodiments, the actuation assembly 130 has at its lower end the magnet unit 156, which cooperates with the pin assembly 165, which cooperates with aperture 180 and/or scooping-surface 195, for performing multiple steps/functions at the same time or generally the same time.

Figure 18:
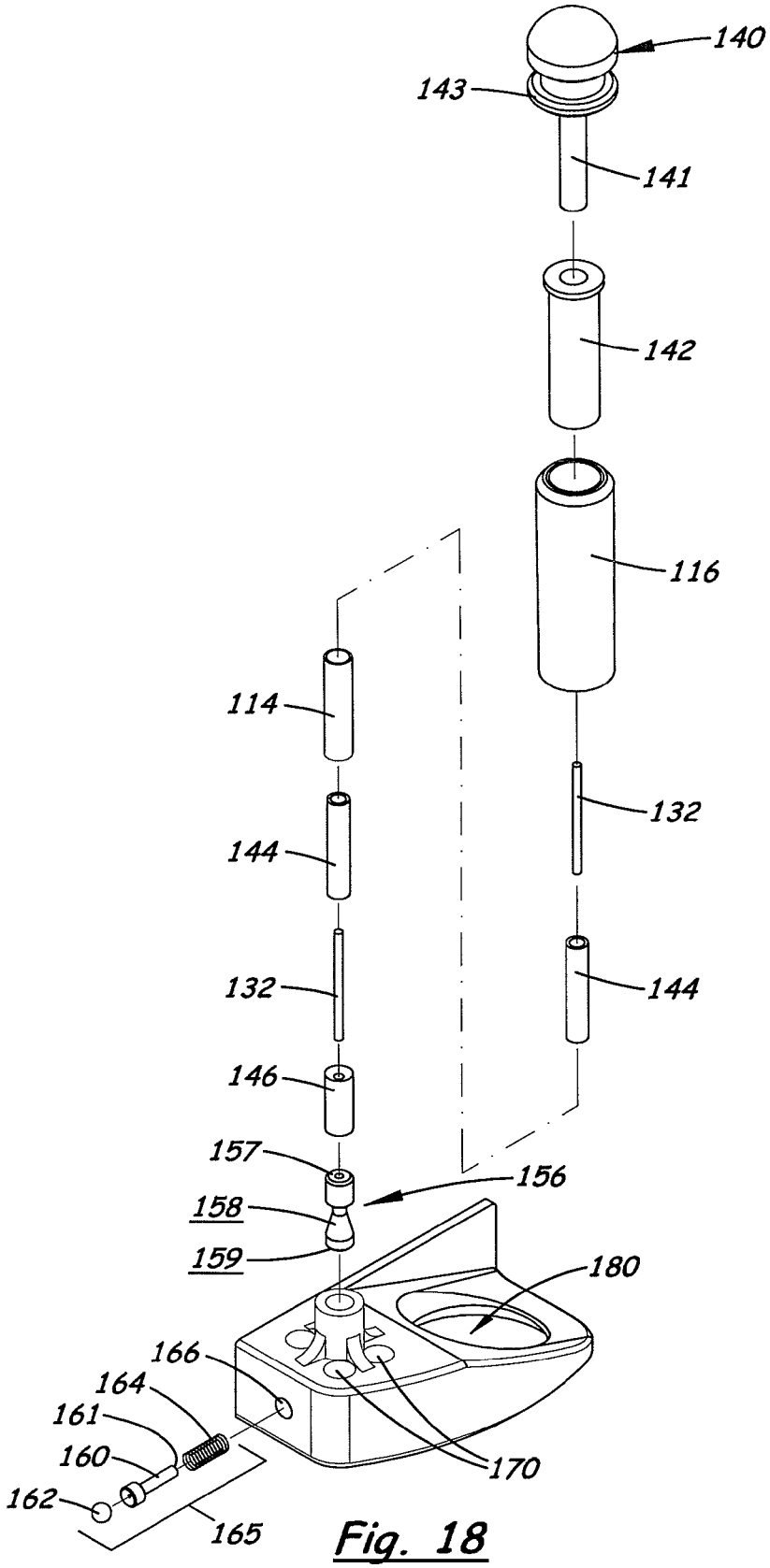
FIG. 18 is an exploded view of the club of FIG. 15.

The actuator rod 132 is preferably a continuous piece, fixed to, and extending all the way between, the plunger 140 and the magnet unit 156. The actuator rod 132 is preferably sufficiently flexible to bend/curve as it slides along the inside of said bent/curved shaft during operation. The upper bushing 142 and lower bushing 146 are received around the rod 132 at the upper end and lower end of the rod, respectively, and are fixed to the shaft 114. The sheath is also received around the rod, extending between the bottom of the upper bushing 142 and the top of the lower bushing 146, and is fixed to or at least retained between the bushings 142, 146. Thus, the plunger lower end 141 connects to the rod 132, and the rod 132 connects to the top end 157 of the magnet unit 156. Plunger lower end 141, rod 132, and magnet unit 156 are preferably coaxial. The upper bushing 142, sheath 144, and lower bushing 146 are received around the coaxial with the plunger-rod-magnet-unit assembly. FIG. 18 shows the actuator rod 132 and sheath 133 in two places, to illustrate the relationship of the rod and sheath to the other elements, but it may be understood that the rod is preferably a single piece extending all the way from the plunger to the magnet unit and the sheath is preferably a single piece extending all the way between the two bushings 142,146.

Figure 16:
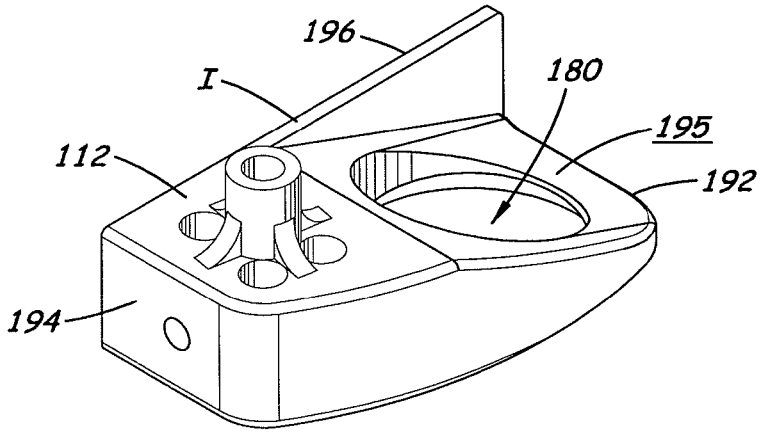
FIG. 16 is a rear perspective view of the head of the club of FIG. 15.
Figure 17:
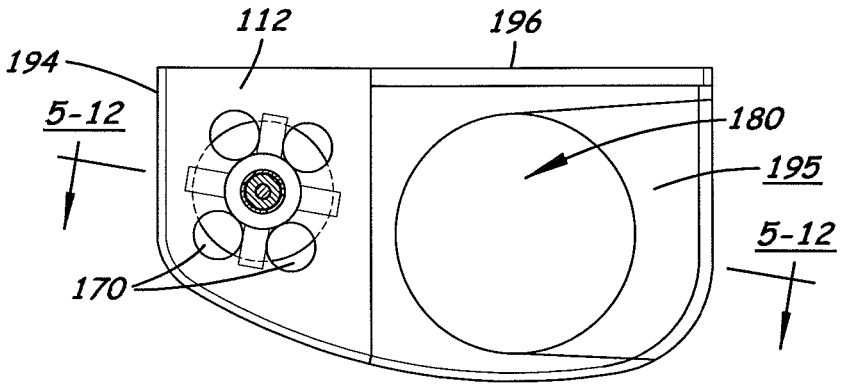
FIG. 17 is a top view of the head of the club of FIG. 15.
Figure 26:
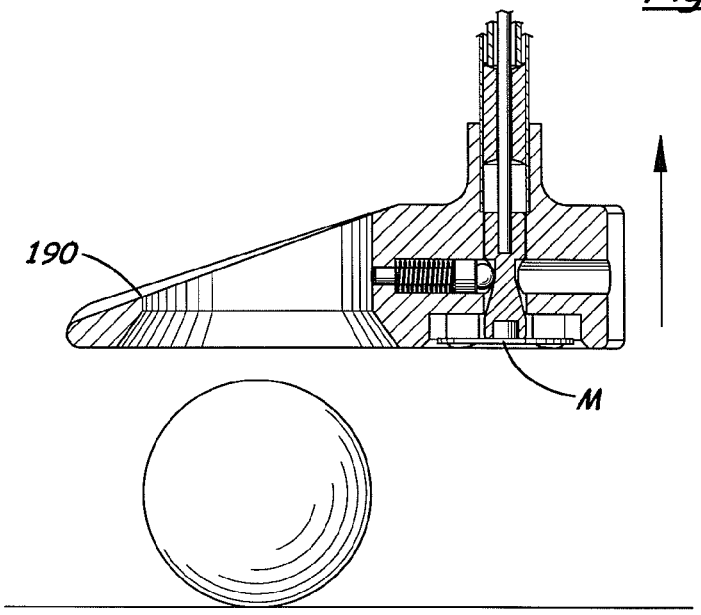
FIG. 26 shows in cross-section the head of the club of FIG. 15 being removed from the site of the ball after the head has been lowered in FIG. 25 and the actuation assembly moved to the first position to recapture the marker and allow the ball to drop to the green.
Figure 27:
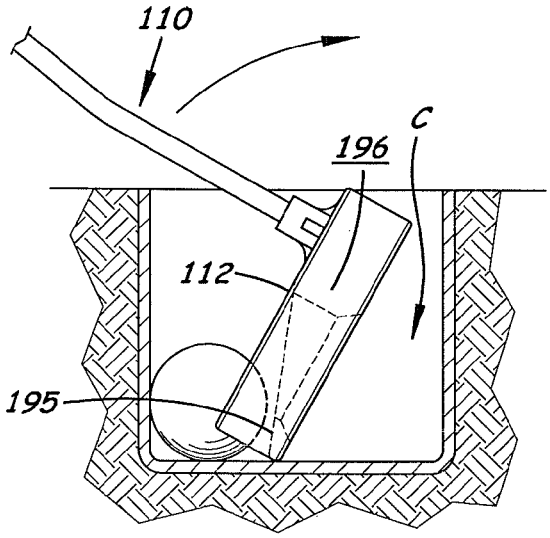
FIGS. 27-29 are sequential views of steps that may be performed with the club of FIG. 15 to scoop a ball out of a putting green cup.
Figure 28:
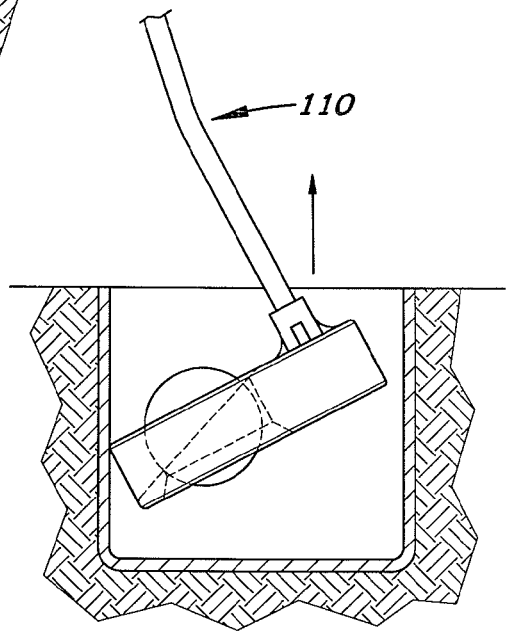
Figure 29:
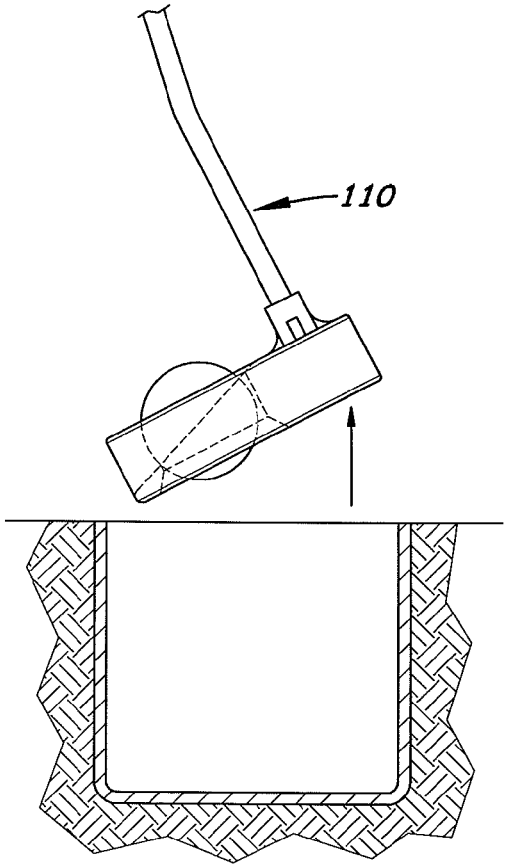
Figure 30:
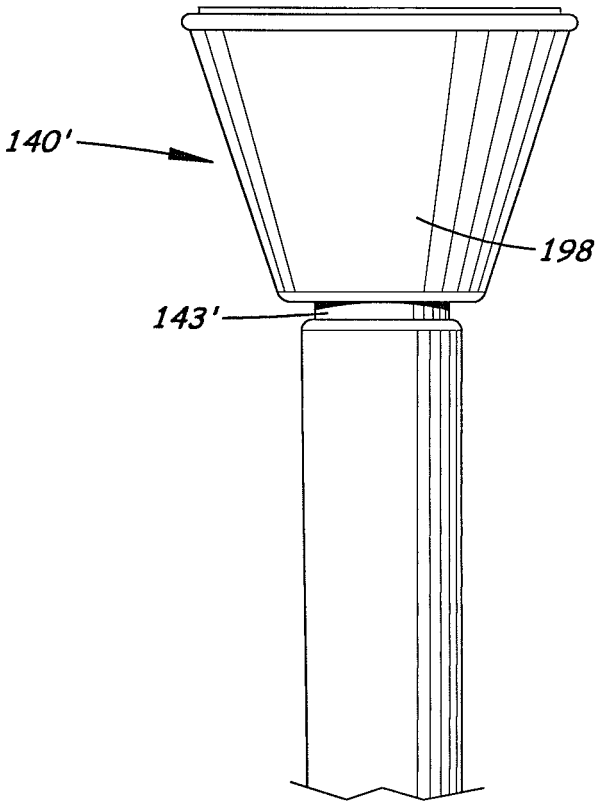
FIG. 30 is a side view of an alternative plunger, having a ball-retrieval cub, for a club such as that in FIG. 15.

Examples of operation of club 110 may be seen in FIGS. 19-29. FIGS. 19-26 portray use of the club 110 on a green to generally simultaneously place a marker M and pickup the ball B, or generally simultaneously place the ball B and pickup the marker M. FIGS. 27-29 portray use of the club to scoop up a ball from the hole. One may note that the face 196 of the head 112, which is used to hit the ball, is not visible in the cross-sectional views of FIGS. 19-26, while the face 196 is visible in FIGS. 27-29. One may also note that a mark, notch, or other indicia I may be placed at the centerline between distal end 192 and proximal end 194 of the head, along which centerline it may be most desirable to impact the ball (FIG. 16).

Figure 19:
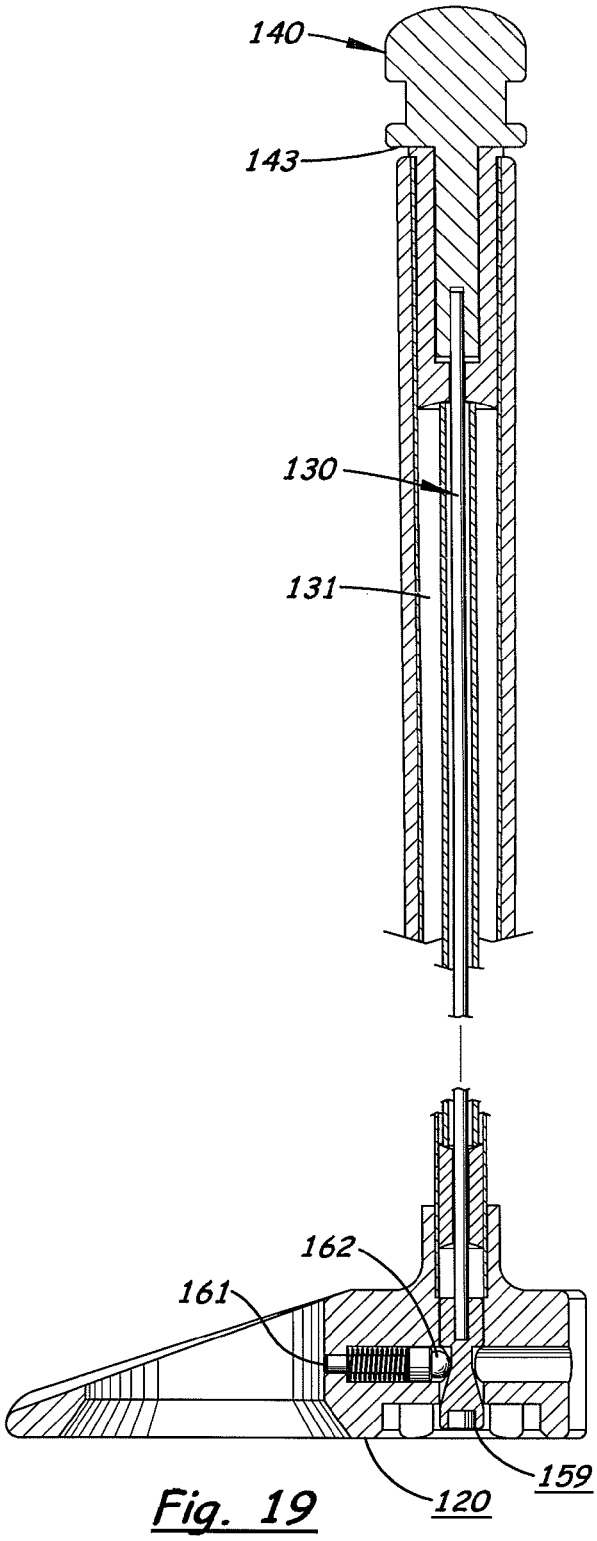
FIG. 19 is a partial cross-sectional view of the club of FIG. 15, shown with the actuation assembly in a first position wherein the magnet is near the recess in the bottom of the head for capturing the marker and the pin member of the ball-handling system is withdrawn from the aperture in the head.

In FIG. 19, club 110 is shown in longitudinal cross-section, with the actuation assembly 130 in a first position, which may be also be called the "pushed-in" position, wherein the plunger 140 has been pushed longitudinally in all the way toward the head of the club until a stop is reached, which, in this embodiment, is the ledge 143 abutting against the grip end of the club. As the actuation assembly 130 is rigid, this pushing-in of the plunger moves the magnet unit 156 into its lowest position in the head 112, wherein its bottom surface 159 is in the recess 122 and near the plane of the bottom surface 120 of the head.

It may be noted that the magnet unit 156 may comprise materials and/or parts that are not magnetic, as long as there is a magnetic portion at or near the bottom of the magnet unit or otherwise positioned so that the magnetic force is of sufficient strength to attract the magnetic marker when the lower end of the magnet unit is moved down to the recess. For example, a magnet housing/holder may comprise a metal or plastic body that is attached to the end of the rod 132, which body is not magnetic but which houses an attached or embedded magnet. In the magnet unit 156 of FIGS. 18-26, the magnet unit 156 comprises top end 157 and side surface 158 that are not magnetic, and bottom surface 159 that is magnetic. In certain embodiments, a surface of the magnet will be exposed at or near the bottom of the housing/holder body, as is the case in the magnetic bottom surface 159 of magnet unit 156. In certain embodiments, a thin portion of the housing/holder, or other casing or cover, may extend over the magnet (entirely or substantially encasing the magnet), but the magnet and the housing/casing/cover will be designed to provide sufficient magnetic force. In certain embodiments, more than a bottom portion/region of, or the entire, magnet unit may be magnetic, but this is typically not necessary.

It may be noted that the magnet unit described herein is one example of a "head-end system" or "head-end unit" of an actuation assembly. Such head-end systems, so-called because they are provided in or near the club head, may perform multiple functions, for example, magnetized handling of the marker, and/or actuation of a ball-engagement assembly or ball-retention assembly to capture a ball in the head or release the ball from the head as desired. Both of these functions may be performed by a single unit such as the magnet unit described herein, but alternatively, may be performed by two units provided close together at the head-end of the actuation assembly. Providing a magnet in a body that also controls the ball-engagement/retention assembly (for example, a side surface of the body cooperating/interacting with the ball-handling pin assembly) provides a compact and effective head-end system for many clubs.

The magnet unit 156 comprises a narrow portion that is smaller in transverse dimension than the enlarged portion of the magnet unit directly below said narrow portion. This may take the form of the narrow portion having a smaller diameter than the enlarged portion. For example, the enlarged portion may be close to the diameter of the bore in the head, while the narrow portion may have a diameter about 10-70 percent, and more preferably 40-60 percent, less than the enlarged portion. The differing-transverse-dimension portions of the magnet unit may be formed by the side surface 158 of the magnet unit being smoothly slanted/curved from the narrow portion to the enlarged portion, so that said slant/curve forms what may be called a notch 125 or other depression in the side surface. A smooth transition between the narrow-dimension and enlarged-dimension portions of the magnet unit is important in order to allow a biased pin assembly 165 to slide along said side surface 158, as described below.

The bias of spring 164 urges the ball-bearing 160 and pin 160 toward the slanted/curved side surface 158 of the magnet unit, and, with magnet unit 156 in the position shown in FIG. 19, the ball-bearing 162 is urged against the narrowest portion of the magnet unit (notch 125) formed by the slanted/curved side surface 158. This notch 125 allows the pin assembly 165 to move away from the aperture 180, so that the tip 161 of pin 160 is substantially or entirely out of the aperture 180.

Figure 20:
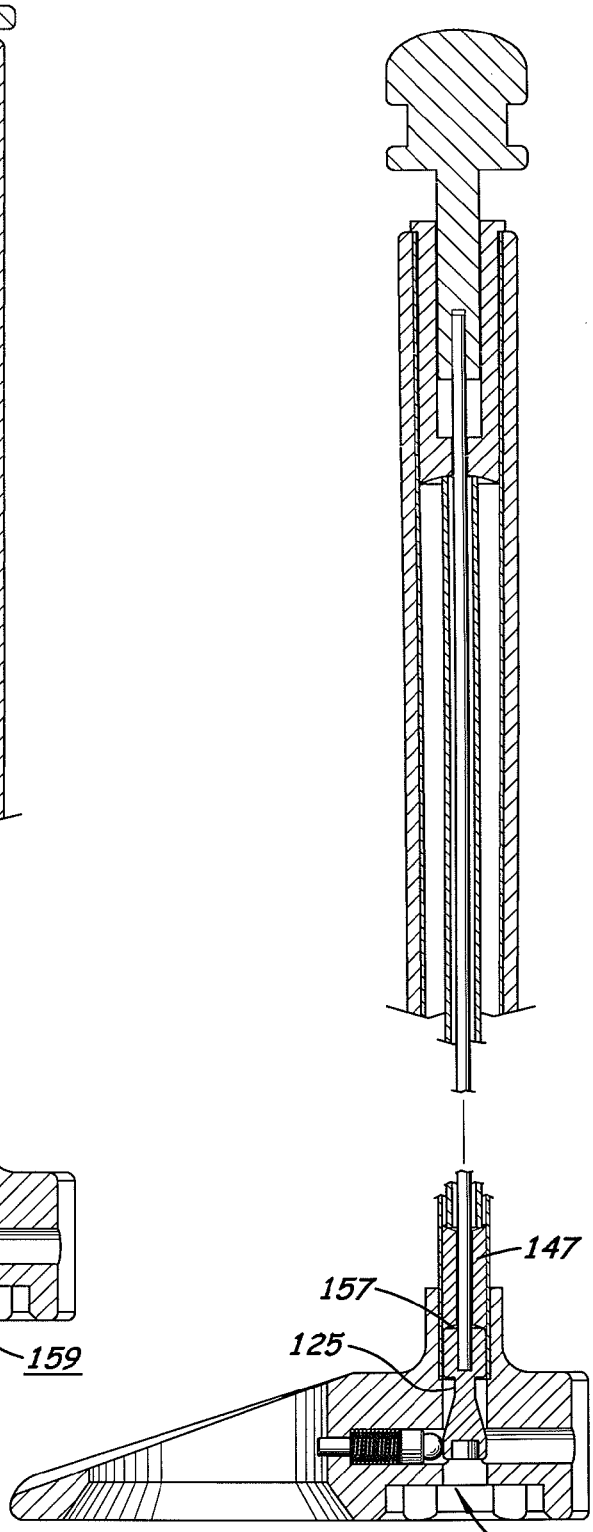
FIG. 20 is a partial cross-sectional view of the club of FIG. 15, shown with the actuation assembly in a second position, wherein the magnet is distanced from the recess for letting the marker drop but the pin member of the ball-handling system is protruding into the aperture for holding a ball in the head.

In FIG. 20, the plunger 140 is in a second position, which may be also be called the "pulled-out" position, wherein the plunger 140 has been pulled away from the head of the club until a stop is reached, which in this embodiment is the top surface 157 of the magnet unit abutting against the bottom surface 147 of the lower bushing 146. Movement into this position, causes the slanted/curved surface 158 of the magnet unit to push the pin assembly 165 outward, away from the longitudinal bore 131 of the shaft, to a position wherein the pin tip 161 protrudes into the aperture 180.

Figure 21:
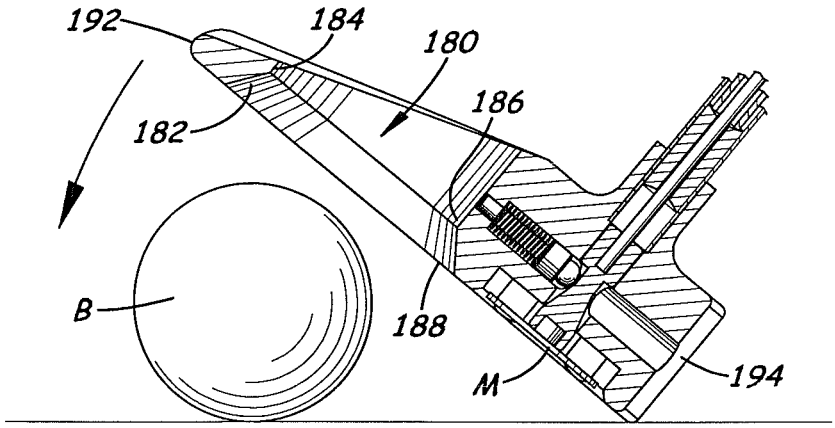
FIG. 21 shows in cross-section the head of the club of FIG. 15 holding a marker, with the actuation assembly in the first position, being lowered over a ball.
Figure 22:
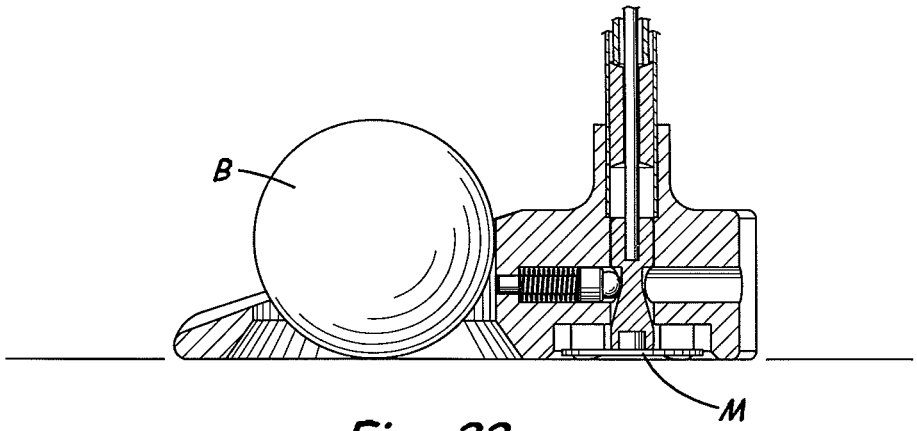
FIG. 22 shows in cross-section the head of the club of FIG. 15 over the ball after the step shown in FIG. 21.
Figure 23:
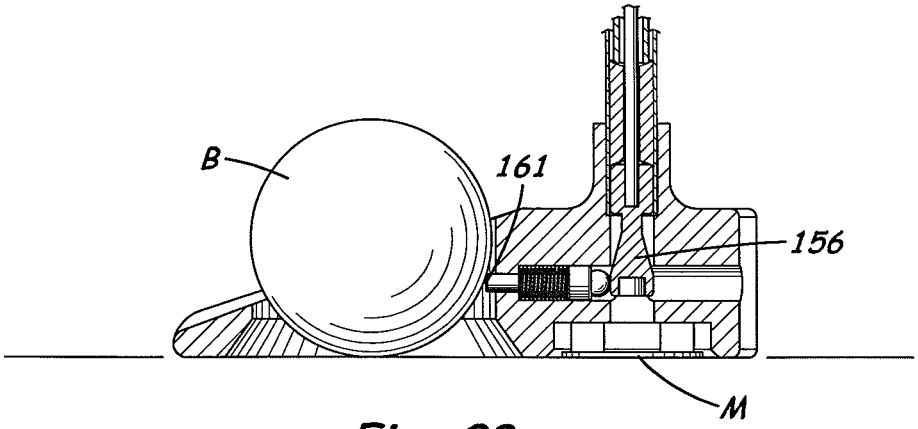
FIG. 23 shows in cross-section the head of the club of FIG. 15 over the ball, but with the actuation assembly actuated to drop the marker to the green and to push the pin member into the aperture to contact or come near to the ball below the equator of the ball.

In FIGS. 21-23, one may see how a ball may be captured in the head 112, by operation of the ball-handling system 111. In FIG. 21, the heel of the head 112 (corner of proximal end 194 of the head) is rested on the green near the ball, and the club is pivoted to move the head 112 down over the ball to the position shown in FIG. 22, so that the ball B is received in the aperture 180, without the user having to bend over or squat. The aperture 180 may be adapted to smoothly slide down over the ball. For example, the lower portion of the aperture 180, defined by lower wall 182, may have a larger diameter than the upper portion, defined by upper wall 184. The lower wall 182 is preferably slanted from its upper end (at corner 186) to its lower end at aperture lower edge 188, so that lower wall 182 is generally conical. Upper wall 184 may be generally right-cylindrical, for example. Further, lower wall 182 may be slightly oblong, so that the aperture near lower edge 188 has a larger diameter parallel to the length of the head (left to right in FIG. 22) than the diameter of the aperture transverse to the length of the head (into the paper in FIG. 22). This way, there is extra leeway for the head 112 to pivot down over the ball, to the position shown in FIG. 22. Alternatively, the head 112 may be pivoted in other directions, for example, by resting the distal end 192 of the club on the green and pivoting the proximal end 194 down over the ball to the position shown in FIG. 22. Or, the head 112 may be kept level and lowered straight down over the ball to the position shown in FIG. 22.

Note that, in FIGS. 21 and 22, the actuation system 130 is in the pushed-in position, so that the pin assembly 165 is biased away from the aperture 180 and tip 161 does not abut the ball or otherwise block the ball from entering the aperture. Note, too, that the marker M is held by the bottom surface 159 (the magnetic portion of the magnet unit 156) in the recess 122.

In FIG. 23, the plunger 140 has been pulled to move the magnet unit away from the recess 122, which lessens the attraction of the marker to the magnet/magnetic portion and drops the marker M to the green and simultaneously pushes the pin 160 to place tip 161 in the aperture to capture the ball in the aperture 180. Again, this occurs without the user having to bend over or squat. Note that the placement of the pin assembly 165 in the head results in tip 161 being slightly underneath the equator of the ball B, that is, slightly underneath the largest-diameter portion of the ball.

Figure 24:
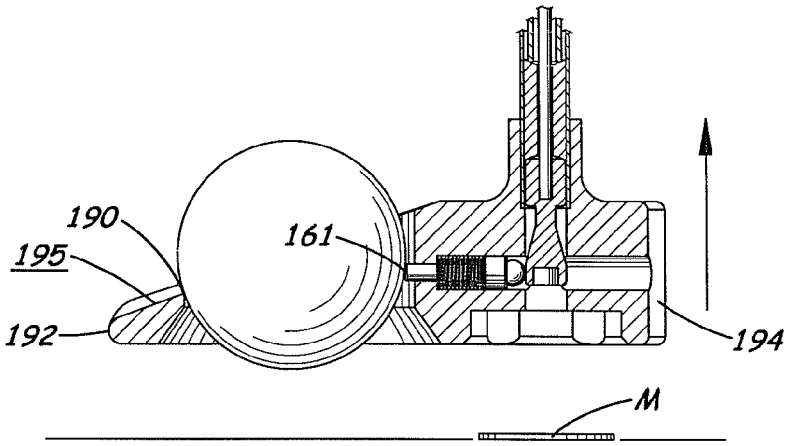
FIG. 24 shows in cross-section the head of the club of FIG. 15 being raised up from the green, with the ball held in the head by the pin member and the marker left behind on the green.
Figure 25:
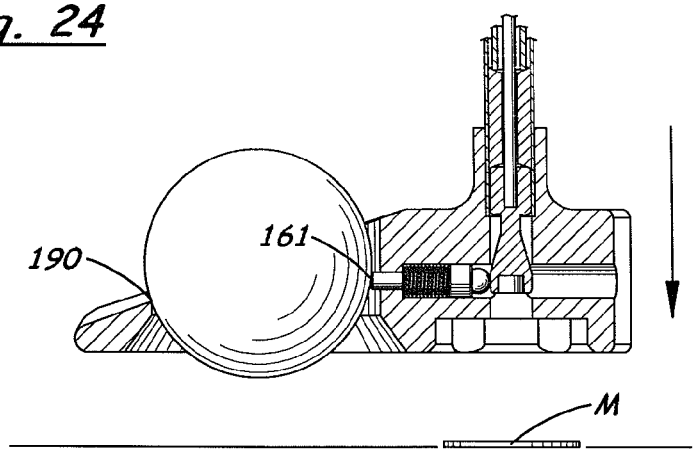
FIG. 25 shows in cross-section the head of the club of FIG. 15, when it is time for the user to putt, for example, being placed down over the marker again, with the ball still in the head. Note that the actuation assembly is still in the second position, to hold the ball in the aperture of the head.

In FIG. 24, the club 110 is lifted upwards, taking the ball with it and leaving the marker behind. Even though the ball may settle slightly down in the aperture 180, the ball is still restrained from falling out of the aperture by pin 160. One may see, in FIG. 24, that the pin and the distal upper edge 190 of aperture 180 contact the ball slightly below the equator, to support the ball in the aperture. By thus capturing the ball in the head, the ball does not fall through the aperture 180, but, if desired, the user may raise the head 112 high enough to grab the ball and remove it from the top of the head, without bending or squatting. The user may grasp approximately the top half of the ball to lift it out of the aperture, as there is little, and preferably no, impediment from the ball moving up through and out of the aperture at the top of the head 112.

With the marker in place and the ball removed from the green, the user may wait his/her turn to putt. When his/her turn comes, the user may again approach the area where the marker rests. If the ball was left in the aperture, the user merely lowers the head over the marker, without bending or squatting. If the ball had been removed from the head, the user merely raises the head again to a level where he/she can replace the ball easily in the head (through the top of the aperture, with the tip 161 still protruding into the aperture), and then lowers the head over the marker, without bending or squatting. In either case, the user may view the marker through the sight-holes 170, to generally center the recess 122 over the marker M, with the length of the head 112 pointing in the correct direction based on memory of the original location of the ball. Once the head 112 reaches the green (appearing as in FIG. 23), the user will push the plunger to again move the magnet unit 156 nearer to, or into, the recess 122, so that the magnetic portion (surface 159) is close enough to the marker M to attract the marker to hold it in the recess. As the magnet unit 156 moves downward in this step, the ball-bearing 162 slides along the slanted/curved side surface 158 of the magnet into the small-diameter portion of the magnet unit (notch 125), and the pin moves away from the aperture. With the pin tip 161 thus-moved-out of the wall, the ball is free to fall through the aperture to remain on the green when the club is again lifted up from the green (FIG. 26).

One may notice that club 110 is particularly well-adapted for consistent and accurate ball placement, that is, replacing the ball on the spot where it originally lay. Because the ball-handling aperture 180 is a set distance from the recess 122, the ball and marker will be the same distance from each other during the steps shown in FIGS. 21-26, whereby the head 112 performs a mechanical guide function. In most embodiments, the only variation in the ball-marker distance will be the variation in marker location inside the recess (the marker may not always be perfectly centered in the recess), due to the recess 122 being larger than the marker. The consistent ball-marker distance results in more consistent and accurate ball placement compared to hand placement by the golfer. A golfer performing ball marking and ball replacement by hand has only his memory, habit, and/or estimation/guessing to ensure that the ball is replaced relative to the marker as it should be, and such hand-placement will therefore result in as much as an inch of inaccuracy, for example. Club 110 will allow placement within a few millimeters (for example, 1-10), with most or all of the inaccuracy being a function of the golfer's ability to place the head in FIG. 25 in the same orientation (distal end pointing same direction relative to the marker) as he/she did in FIGS. 21 and 22.

In an alternative use of the club, certain elements of the ball-handling system may be used to lift a ball up from inside a putting green cup. FIGS. 27-29 show how the head 112 may be placed into the cup C, and the club 110 swung/pivoted to push the ball against the wall of the cup, to scoop-up the ball into the aperture 180 through the top of the aperture. Preferably, the majority of distal end 192 of the head is recessed or otherwise made thin, so that it is thin from top to bottom compared to proximal end 194, and also thin compared to face 196. This takes the form of scooping surface 195, which is curved or slanted downward from at or near proximal end 194 to distal end 192. This scooping surface 195 allows the ball, when pressed against the wall of the cup C, to roll across said surface 195 into the aperture 180. The actuation assembly is in the pulled-out position during the steps shown in FIGS. 27-29, so that pin tip 161 protrudes into the aperture to hold the ball in the head. This way, the club may be lifted, with the ball, up from the hole, to be grabbed by the user for transport to the next tee, for example.

In alternative methods, a user might wish to lift or replace a ball without dropping/picking-up a marker. The user may use the methods illustrated in FIGS. 21-26, without a marker in the recess. Alternatively, the user may place the head on the green/course with the distal end 192 near the ball, and then the user may use his/her foot, with or without pushing the head toward the ball, to push the ball up and along the scooping surface 195 until the ball rests in the aperture. Here again, no marker would be used and the plunger would be in the pulled-out position to insert the pin tip 161 into the aperture to hold the ball in the aperture. Alternatively, the club may be provided with a plunger 140' (FIG. 30) having a ball-retrieving cup 198 instead of a knob-style-handle. After lifting a ball with such a cup 198, the user may grasp the ball to remove it from the cup 198, as there may not be any ejector in this cup embodiment.

Figure 31A:
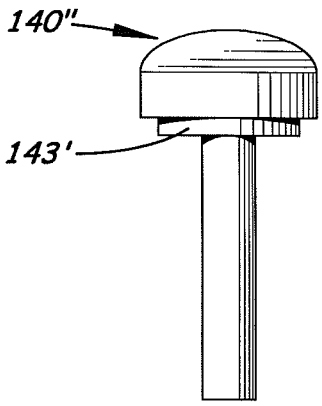
FIGS. 31A and B are a side view, and a cross-sectional view, respectively, of an alternative plunger for a club such as that in FIG. 15.
Figure 31B:
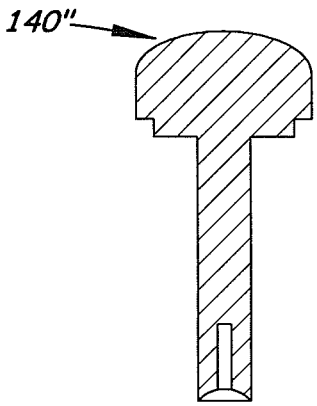
Figure 32:
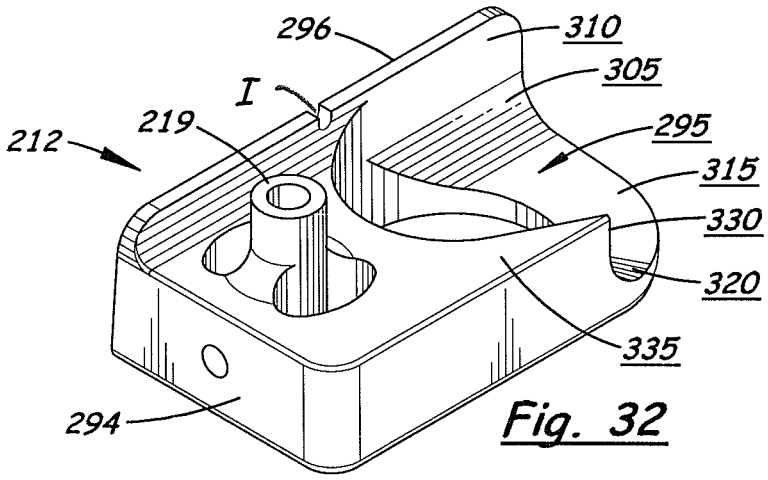
FIG. 32 is a rear perspective view of an alternative head such as may be connected to a club such as that in FIG. 15.
Figure 33:
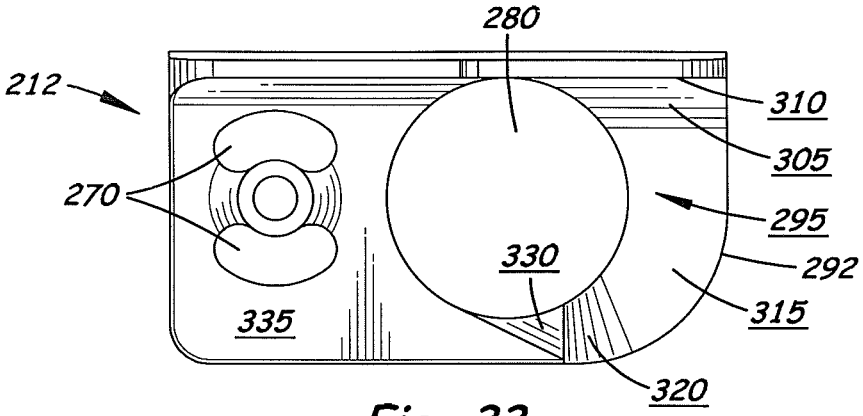
FIG. 33 is a top view of the head of FIG. 32.
Figure 34:
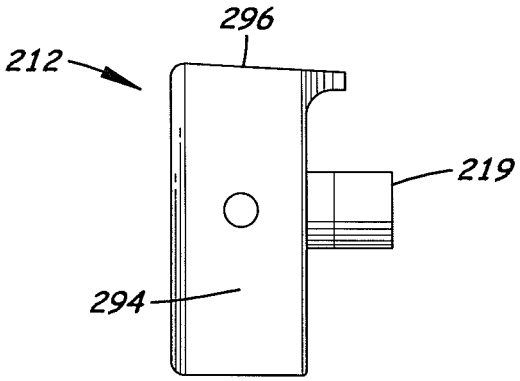
FIG. 34 is a proximal end view of the head of FIG. 32.
Figure 35:
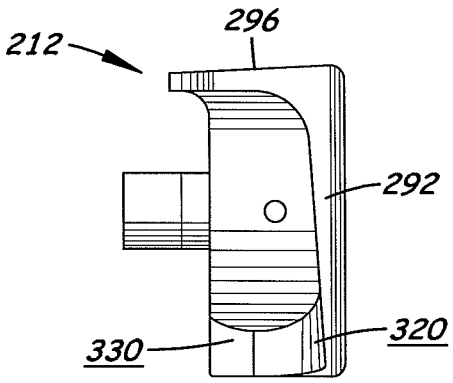
FIG. 35 is a distal end view of the head of FIG. 32.
Figure 36:
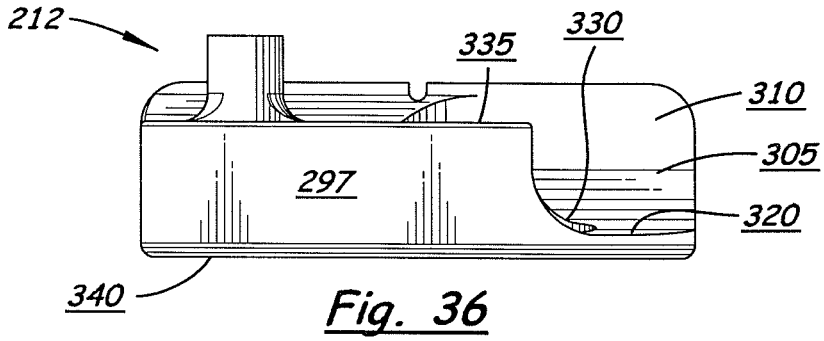
FIG. 36 is a rear view of the head of FIG. 32.
Figure 37:
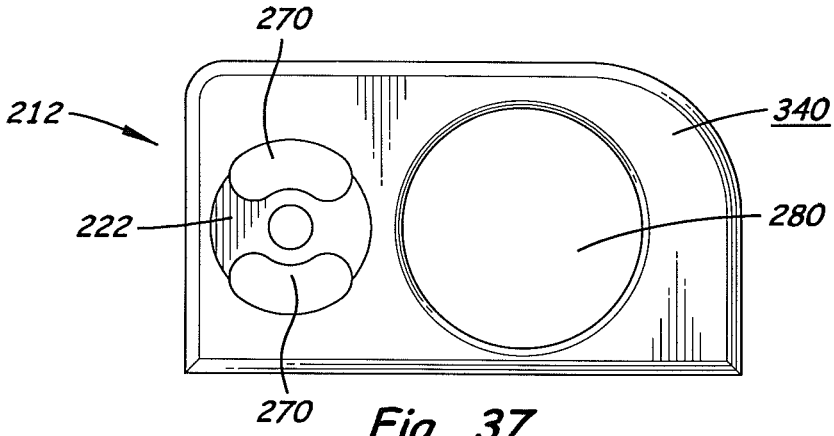
FIG. 37 is a bottom view of the head of FIG. 32.
Figure 38:
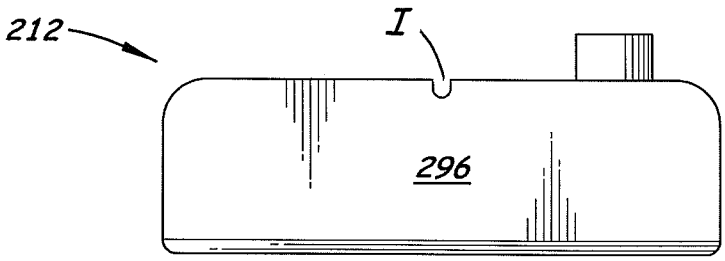
FIG. 38 is a front (front face) view of the head of FIG. 32.

FIGS. 31A and B illustrate an alternative plunger 140", having a knob-style-handle protruding up from alternative ledge 143'. Note that the relatively-small-diameter ledge 143' of FIGS. 30 and 31A and B provides room for the relative-larger handle to be easily grasped, whether it is a knob, a cup, or other shape. Also, this alternative plunder 140" and its knob, as portrayed in FIGS. 31A and B, are shaped so that a rubber ball-pick-up cup such as cup 198 or most conventional ball-pick-up cups, may be easily fit onto the knob, for users who do not want to use the putter head to pick up or scoop up the ball.

FIGS. 32-38 illustrate an alternative head 212 that may be used in place of heads 12 and 112 or on other clubs, for example, by attachment to the club shaft at collar 219. Head 212 has many of the same or similar features of heads 12, 112, but features a generally rectangular shape, two sight-holes 270, and modified scooping surface 295 surface slanting/curvature. Club 212 comprises recess 222, aperture 280, front face 296, rear wall 297, distal end 292, proximal end 294, top surface 335, and bottom surface 340.

The scooping surface 295 comprises a curved front corner area 305 that slopes/curves from the generally vertical rear surface 310 of face 296 to a mid-trough region 315. The mid-trough region curves/slopes to the trough 320, which is the lowest region of the scooping surface 295. Rear slope 330 transitions from the generally-horizontal rear-top surface 335 of the club to the trough 320. Thus, the trough 320 is at or near a rear, distal region of the head and is the "lowest" or "narrowest" portion of the distal end of the head 212. The surrounding surfaces (305, 315, and 330) curve (or slope or slant) down to the trough 320, and a ball will tend to roll to and across the trough 320 and across the trough 320 to enter the aperture 280, generally as described above for club 110.

In FIGS. 15-38, certain embodiments of actuation, ball-handling, and marker-handling assemblies are drawn. Other arrangements, shapes, and sizes of elements may be used to transmit force from at or near the grip end of the club to the elements for ball-handling and/or marker-handling. For example, alternative handles/plungers, rods, magnet and/or magnet unit shapes, pins, bearings, spring/bias members, bushings, and/or other supporting, sliding or centering members, may be used in certain embodiments.

Certain embodiments may be described as a golf club comprising: a club shaft having a first end, a second end, and a longitudinally-extending interior space, a grip surface near the first end, and a head at the second end for hitting a golf ball, wherein the head has a top surface, a bottom surface with a recess, and a bore in the head that is open to the interior space of the shaft; an actuation assembly in said interior space and having an assembly first end near the first end of the club shaft and an assembly second end near the head and/or the second end of the shaft, a magnet, or more preferably a magnet unit comprising a housing/holder and a magnet/magnetic portion at the assembly second end, wherein the actuation assembly is slidable in said interior space to a first-position wherein the assembly is urged toward the head to place the magnet/magnetic portion at least partially in the bore of the head and near enough to the recess to attract a ball-marker comprising a magnetic material into the recess, the actuation assembly further being slidable in an opposite direction in said interior space to a second-position that moves the magnet/magnetic portion away from the recess to distance the magnet from the recess and the ball-marker to release the ball-marker from the recess due to said distance resulting in less attraction of the marker to the magnet/magnetic portion. Preferably, the actuation assembly is substantially straight and the bore in the head is coaxial with the interior space of the shaft. Certain embodiments of the recess are defined by a curved wall with a center and a perimeter edge, wherein the recess is relatively more shallow at said perimeter edge than at said center. Typically, but not necessarily, the magnet unit and the magnet/magnetic portion will be coaxial with the bore, the interior space of the shaft, and the center of the recess. The marker need not, and preferably does not, fit tightly in the recess; for example, the recess may have an outer diameter that is larger the outer diameter of the marker. The recess outer diameter may be 20-70 percent larger than the outer diameter of the ball-marker, or other percentages as discussed herein, for example. The magnet/magnet unit may entirely in the bore of the head when the actuation assembly is in the first-position and only partially in the bore of the head when the assembly is in the second-position, for example, or other arrangements as desired (depending for example on the strength of the magnet/magnetic portion).

Certain embodiments of the club, for example the club as described in the paragraph immediately above, comprise the head having an aperture from said top surface to said bottom surface and a slidable ball-engagement assembly slidably received in a transverse bore in the head, wherein the transverse may be described as generally transverse/perpendicular to said bore in the head and/or to the longitudinal axis of the shaft. The transverse bore will be parallel in certain embodiments to the length of the head, and, because the angle of the shaft to the length of the head (from proximal end to distal end) is typically not exactly 90 degrees, the transverse bore is described for many embodiments as being "generally transverse/perpendicular" to said bore/axis rather than exactly transverse/perpendicular. An end of said ball-engagement assembly contacts the magnet unit and an opposing end of said ball-engagement assembly is near the aperture but not protruding any significant distance into the aperture when the actuation assembly is in the first position. When the actuation assembly is in the second position, said opposing end of the ball-engagement assembly protrudes into the aperture when the actuation assembly to contact a ball received in the aperture, preferably in a manner that will support and retain the ball in the aperture. As the aperture is the same diameter or more preferably slightly larger than the ball, said opposing end protruding into the aperture serves to block movement of the ball down through the aperture, or, in effect, to reduce the effective diameter of the aperture to less than the equator diameter of the ball.

Certain embodiments of the golf club, for example the club as described in the two paragraphs immediately above, may comprise the magnet unit having a side surface having a depression, inward-slanted area, or otherwise reduced portion. When the actuation assembly is in the second position, said ball-engagement assembly slides in said transverse bore toward said bore so that said end of the ball-engagement assembly rests in the depression, inward-slanted area, or otherwise reduced portion. This sliding of the ball-engagement assembly causes said opposing end to withdraw from the aperture, completely or at least to an extent that said opposing end completely leaves contact with the ball (any region of the ball including the equator) or at least withdraws enough to allow the ball to pass unhindered down through the aperture. Certain but not necessarily all embodiments of said ball-engagement assembly may comprises a pin having an outer end and an inner end, a ball-bearing at said inner end, and a spring that biases the pin toward the bore to push the ball-bearing against the magnet unit, wherein said end of the ball-engagement assembly is the ball-bearing (so that it rolls along the magnet unit side surface, without snagging or being hung-up, as the actuation assembly moves the magnet unit) and said outer end of the pin is said opposing end that moves inward and outward relative to (preferably the proximal region of) the aperture.

Certain embodiments of the golf club, for example any of the embodiments described in the above three paragraphs, may include the actuation assembly comprising a plunger extending out from said interior space near the grip surface of the club, and the plunger comprising a handle for pushing and pulling the actuation assembly into the first and second positions. Typically but not necessarily in all embodiments, the actuation assembly is not biased into the first position or the second position but rather is frictionally retained or otherwise retained in each of the first position or the second position after the user moves the plunger into those positions. In other words, the user may preferably move the plunger and remove his/her hand from the plunger, and the plunger and the actuation assembly remain in that position until the user purposely moves the plunger again. The plunger is one example of how preferably only a single handle is used for access by a user, said single handle being adapted to push and pull the actuation assembly to said first position and said second positions, respectively. Preferably, the single handle is generally or substantially or entirely parallel to the longitudinal axis of the shaft of the club.

Certain embodiments of the golf club, for example any of the embodiments described in the above four paragraphs, may be described as the head having a proximal end and a distal end (a head length extending between said proximal and distal ends). The shaft may be connected to the head nearer the proximal end than the distal end. The head may comprise at least one and preferably multiple sight-holes through the head from the top surface near the shaft to the recess, so that the ground/green (and/or the ball-marker beneath or in the recess) is visible through the sight-holes. This helps the user "aim" the head to place and lower the recess directly over the marker, so he/she can accurately capture the marker. With the shaft connecting to the head nearer the proximal end, space typically remains nearer the distal end, so that the aperture may be provided nearer the distal end than the proximal end.

Certain embodiments of the golf club, for example any of the embodiments described in the above five paragraphs, may be described as comprising surface(s) that allow scooping up the ball in one or more settings. The top surface of the head may have a scooping-surface-portion that is slanted or curved downward from the aperture toward the distal end so that at least a portion of the distal end has a thickness from the top surface to bottom surface that is smaller than the thickness of the proximal end. Said scooping-surface-portion may have a trough that is the lowest region of said scooping-surface-portion, and it is this trough over which the ball may typically roll to enter the aperture. The preferred head is generally rectangular, a front wall of "front face" that is generally flat and generally vertical, but in many embodiments slightly slanted rearward a few degrees so that the top edge is slightly rearward from the bottom edge of the front face. The front face is for hitting a ball, typically in a put stroke. Opposite the front face is a rear wall. The trough may therefore be described as at a rear distal region of the head.

Certain embodiments of the invention are methods of using a golf club. For example, certain embodiments may be a method of handling a golf ball and a ball-marker with a putter to reduce bending and squatting by a golfer, the method comprising: providing a golf club comprising a club shaft having longitudinal axis between a first end and a second end, the golf club having a grip surface near the first end and a head connected to the second end for striking a golf ball, wherein the head has a bottom surface with a recess, a magnet-unit-bore generally parallel to said shaft, and a transverse-bore generally perpendicular to said bore; the golf club may further comprise an actuation assembly slidably-received inside said club shaft (and typically the bottom end of the actuation assembly slidably received in the magnet-unit-bore of the head), the actuation assembly having a handle near said grip and protruding axially out beyond the shaft first end, and a magnet unit on said assembly second end and received at least in part inside the magnet-unit-bore in a first position at or near the recess, the magnet unit having a slanted/curved side surface forming an enlarged portion of the magnet unit and a relatively-smaller reduced portion; wherein the head comprises an aperture extending through the head from a top surface to bottom surface of the head, and a ball-engagement assembly slidably received in the transverse-bore having a tip-end at or near the aperture and an opposing end contacting said side surface of the magnet unit; the method further comprising placing a marker in the recess so that the marker is held in the recess by the magnet/magnetic portion of the magnet unit, lowering the head over a golf ball on a green so that the aperture encircles the ball; pulling the handle axially upward from the shaft so that the actuation assembly slides axially in the club to move the magnet unit to a second position distanced from the recess and marker, whereby the marker drops from the head to the green and whereby the enlarged portion of the side surface of the magnet unit pushes the ball-engagement assembly outward from the bore to place the tip-end in the aperture below the equator of the ball; and lifting the golf club head whereby the ball remains in the aperture because the tip-end supports the ball in the aperture and prevents the ball from falling out of the aperture. The ball-retention assembly may comprise, for example, a pin (or tab, or other member) having an outer end that is said tip-end, a ball-bearing at an opposing end of the pin, and a spring that biases the pin to push the ball-bearing against the side-surface of the magnet unit. Or, in certain embodiments, a more complex mechanical system may be envisioned that comprises movement other than linear movement of an elongated pin, for example. For example, the actuation assembly movement from the first position to the second position may cause a tab or wing to pivot or slide in various directions into the aperture to block the ball from falling. Preferably, said pivot or sliding is caused by the same actuation that activates the magnet-handling system. Further, after lifting the golf club head to remove the ball from the green, the method may include again setting the head on the green so that the recess is over the marker, and pushing the handle axially downward toward the shaft, whereby the actuation assembly slides downward in the club and moves the magnet/magnetic portion deeper into the bore of the head to move the magnet/magnetic portion near the recess and the marker and to move the reduced portion of the magnet unit adjacent to the transverse bore; whereby the marker is attracted to the magnet/magnetic portion to move into the recess, and the spring biases the ball-engagement assembly to slide inward in the transverse bore to contact the reduced portion of the magnet unit so that the tip-end of the ball-engagement assembly is withdrawn from the aperture to allow the ball to fall to the green.

Certain embodiments of the invention are methods of using the club comprising the marker-handling and/or ball-handling systems described herein.

Alternative shapes for various parts of the club may be used. For example, many different club heads may be used, selected from the many popular putter heads or other heads. The shaft is of the club is preferably connected to the head in such a way and/or angled, bent, or curved, so that the club head may rest in front of the golfer for putting while the grip is comfortably in the golfer's hands. The actuation assembly (for example, assembly 30, 130) may extend the entire or substantially the entire length of the club shaft and slide axially in the club shaft, for example. Flexible or semi-flexible component(s) may be used to allow the assembly to slide through a shaft that is bent/curved, for example, actuator rod 132 may be a flexible metal rod. The grip may have various outward shapes and outward appearances.

By saying that the magnet/magnetic portion is (resides, is moved to) near to the recess and/or the marker (in said first position), it is meant in certain embodiments that the magnetic bottom surface 159 is within 0-1.5 inches of the trough of the recess (the deepest portion of the recess), or more typically 0.1-0.8 inches, and even more typically 0.1-0.5 inches. By distancing the magnet/magnetic portion to the second position, it is meant in certain embodiments, that the magnetic bottom surface 159 is moved at least 0.5 inch farther away from the trough than when in the first position, or more typically at least 0.75 inches or at least 1 inch. The marker may be a circular plate and said recess wall may have a circular outer perimeter, wherein the recess wall curves from the outer perimeter to a deeper recess center at or near the bore, but other shapes of markers and recess may be included in certain embodiments.

The size/strength of the magnet for effectively operating the marker-handling system may be determined without undue experimentation, given the explanation above. For example, in the clubs of FIGS. 15-38, a disk-shaped, or cylindrical, magnet is fixed to, or embedded in, the lower end of a non-magnetic body, to form magnet unit 156. An exposed bottom surface of the disk-shaped magnet forms magnetic bottom surface 159, while the non-magnetic side and top surfaces of the magnet unit body serve the other purposes of the magnet unit as described herein. This exemplary disk-shaped magnet is 3/16 inches in diameter, 1/16 inch thick (axial dimension), and has an axial magnetization direction. This exemplary magnet has a pull force case of 1:1.70 and 2:2.49 lbs.

It is preferred that no electronics, no electrical means, non electrical current, no electromagnet, and no solenoid be provided in or on the club. It is preferred that no cover, lip, ledge, pocket, or other protrusion into the recess be provided to help capture or hold the marker.

Other clubs may be provided with one or both of the systems disclosure herein, but, given the present rules for the game of golf, putters will typically be the clubs provided with the preferred embodiments of marker-handling systems and ball-handling systems.

In less preferred embodiments, the recess in the bottom surface of the club head may be magnetic, and the lower end or "head-end" system of the actuation assembly may be used to push the marker out of the magnetic recess. This would mean that pushing the actuation assembly would be required to drop the marker. If such embodiments include ball-handling systems such as the pin assembly described herein, the head-end system would be redesigned to actuate ball-retention when the handle/plunger is pushed toward the head rather than pulled upwards. For example, alternative slanting/curvature of the head-end system would be required so that pushing the handle/plunger would both push the marker and push the pin assembly distally in the head. In such embodiments, the head-end system would typically not comprise a magnet on/in the actuation assembly. These embodiments are less preferred because optimizing such embodiments to work consistently and well would be difficult or impossible. For example, if the entire recess were magnetic, the marker would likely be captured very inaccurately; the marker would cling to any portion of the recess and/or to the club head bottom outside of the recess, thus probably protruding from the head in an undesirable manner. Reducing the area of magnetic surface in the recess might improve performance, but this would again be difficult or impossible to optimize. The preferred embodiments, on the other hand, control the position of the magnet/magnetic portion inside the club head, and hence control marker-dropping, with surprisingly good and consistent performance. The preferred embodiments in effect remove the magnet from the marker by moving the magnet/magnetic portion in a very controllable and predictable manner, while a push-to-eject marker method would attempt to push the marker away from the magnet. Further, it may be noted that the preferred embodiments allow a convenient, compact, and aesthetic design wherein the handle/plunger is pushed-in most of the time and only pulled outward on the occasion of marker-dropping and ball-capture. A push-to-eject marker method is expected to require a different handle/plunger in terms of at least two of location, operation and aesthetics, as it would be undesirable/unworkable to have a handle/plunger that is pulled axially out from the grip of the club until marker-dropping and ball-capture.

Although this invention has been described above with reference to particular means, materials and embodiments, it is to be understood that the invention is not limited to these disclosed particulars, but extends instead to all equivalents within the scope of the following claims.

We claim:

1. A golf club comprising:

a club shaft having a first end, a second end, and a longitudinally-extending interior space, a grip surface near the first end, and a head at the second end for hitting a golf ball, wherein the head has a top surface, a bottom surface with a recess, and a bore in the head that is open to the interior space of the shaft;

an actuation assembly in said interior space and having an assembly first end near the first end of the club shaft and an assembly second end near the head, a magnet at the assembly second end, wherein the actuation assembly is slidable in said interior space to a first-position wherein the assembly is urged toward the head to place the magnet at least partially in the bore of the head for attracting a ball-marker comprising a magnetic material into the recess, and slidable in an opposite direction in said interior space to a second-position that moves the magnet away from the recess to distance the magnet from the ball-marker to release the ball-marker from the recess.

2. A golf club as in claim 1, wherein said recess is defined by a curved wall with a center and a perimeter edge, wherein the recess is relatively more shallow at said perimeter edge than at said center.

3. A golf club as in claim 1, wherein the recess has an outer diameter that is 20-70 percent larger than the diameter of the ball-marker.

4. A golf club as in claim 1, wherein the magnet is entirely in the bore of the head when the actuation assembly is in the first-position and only partially in the bore of the head when the assembly is in the second-position.

5. A golf club as in claim 1, wherein the magnet is a portion of a magnet unit that is fixed to the assembly second end, and wherein the head has an aperture from said top surface to said bottom surface and a slidable ball-engagement assembly slidably received in a transverse bore in the head that is generally transverse to said bore, an end of said ball-engagement assembly contacting the magnet unit and an opposing end of said ball-engagement assembly protruding into the aperture when the actuation assembly is in said second position to contact a ball received in the aperture.

6. A golf club as in claim 5, wherein the magnet unit has a side surface having a depression, wherein, when the actuation assembly is in the second position, said ball-engagement assembly slides in said transverse bore toward said bore so that said end of the ball-engagement assembly rests in the depression and said opposing end is withdrawn from the aperture and leaves contact with the ball.

7. A golf club as in claim 5, wherein the magnet unit has a curved side surface comprising a small portion that has a transverse dimension perpendicular to said bore that is smaller than a transverse dimension of an enlarged portion directly below said small portion, wherein, when the actuation assembly is in the second position, said ball-engagement assembly slides in said transverse bore toward said bore so that said end of the ball-engagement assembly rests against the small portion and said opposing end is withdrawn from the aperture and leaves contact with the ball.

8. A golf club as in claim 6, wherein said ball-engagement assembly comprises a pin having an outer end and an inner end, a ball-bearing at said inner end, and a spring that biases the pin toward the bore to push the ball-bearing against the magnet unit, wherein said end of the ball-engagement assembly is the ball-bearing and said outer end of the pin is said opposing end.

9. A golf club as in claim 7, wherein said ball-engagement assembly comprises a pin having an outer end and an inner end, a ball-bearing at said inner end, and a spring that biases the pin toward the bore to push the ball-bearing against the magnet unit, wherein said end of the ball-engagement assembly is the ball-bearing and said outer end of the pin is said opposing end.

10. A golf club as in claim 1, wherein the actuation assembly comprises a plunger extending out from said interior space near the grip surface of the club, and the plunger comprising a handle for pushing and pulling the actuation assembly into the first and second positions, respectively, and wherein the actuation assembly is not biased into the first position or the second position.

11. A golf club as in claim 1, wherein the actuation assembly comprises a single handle for access by a user, said single handle being adapted to push and pull the actuation assembly to said first position and said second positions, respectively.

12. A golf club as in claim 11, wherein said single handle extends from the shaft at a grip-end of the shaft.

13. A golf club as in claim 12, wherein the head comprises an aperture from said top surface to said bottom surface for receiving a golf ball and the top surface of the head has a scooping-surface-portion near said aperture that is slanted or curved downward toward the distal end so that at least a portion of the distal end has a thickness from the top surface to bottom surface that is smaller than the thickness of the proximal end.

14. A golf club as in claim 13, wherein said scooping-surface-portion has a trough that is the lowest region of said scooping-surface-portion for a ball to roll over to enter the aperture.

15. A golf club as in claim 14, wherein said head has a front face for hitting a ball, a rear wall opposite the front face, and the trough is at a rear distal region of the head.

16. A golf club as in claim 1, wherein the head has a proximal end and a distal end, the shaft is connected to the head nearer the proximal end than the distal end, and the head comprises an aperture from said top surface to said bottom surface for receiving a golf ball, and the head further comprises at least two sight-holes through the head from the top surface near the shaft to the recess, so that the ball-marker beneath or in the recess is visible through the sight-holes.

17. A golf club as in claim 16, wherein the aperture is nearer the distal end than the proximal end.

* * * * *